US010334366B2

(12) United States Patent
Nakagawa et al.

(10) Patent No.: US 10,334,366 B2
(45) Date of Patent: Jun. 25, 2019

(54) AUDIO PLAYBACK DEVICE

(71) Applicant: SONY CORPORATION, Tokyo (JP)

(72) Inventors: Toshiyuki Nakagawa, Kanagawa (JP); Junya Suzuki, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/518,484

(22) PCT Filed: Aug. 25, 2015

(86) PCT No.: PCT/JP2015/073822
§ 371 (c)(1),
(2) Date: Apr. 11, 2017

(87) PCT Pub. No.: WO2016/064613
PCT Pub. Date: Apr. 28, 2016

(65) Prior Publication Data

US 2017/0238096 A1 Aug. 17, 2017

(30) Foreign Application Priority Data

Oct. 20, 2014 (JP) ..... 2014-213795
Feb. 5, 2015 (JP) ..... 2015-021401

(51) Int. Cl.
*H04R 5/02* (2006.01)
*H04R 5/033* (2006.01)
(Continued)

(52) U.S. Cl.
CPC ..... *H04R 5/0335* (2013.01); *H04R 1/1008* (2013.01); *H04R 1/1091* (2013.01); *H04R 5/04* (2013.01); *H04S 7/30* (2013.01); *H04R 5/033* (2013.01); *H04R 2460/13* (2013.01); *H04S 3/004* (2013.01); *H04S 2400/03* (2013.01); *H04S 2400/11* (2013.01); *H04S 2420/01* (2013.01)

(58) Field of Classification Search
CPC .. H04R 5/0335; H04R 1/1008; H04R 1/1091; H04R 5/04; H04R 5/033; H04R 2460/13; H04S 7/30; H04S 3/004; H04S 2400/03; H04S 2400/11; H04S 2420/01
USPC ..... 381/151, 309, 310, 74, 17, 18
See application file for complete search history.

(56) References Cited

U.S. PATENT DOCUMENTS

2008/0107300 A1* 5/2008 Chen ..... H04R 1/1075 381/380
2009/0259091 A1* 10/2009 Parker ..... A61N 1/36032 600/25
2014/0363003 A1* 12/2014 Kupershmidt ..... H04R 29/00 381/58

FOREIGN PATENT DOCUMENTS

JP 2001-218293 A 8/2001
JP 2006-229373 A 8/2006
(Continued)

*Primary Examiner* — Norman Yu
(74) *Attorney, Agent, or Firm* — Chip Law Group

(57) ABSTRACT

To provide an audio playback device which allows a novel listening experience for a listener by bone conduction from a prescribed position of the head area. [Solution] Provided is the audio playback device including at least one bone conduction device. The bone conduction device is provided at a position to be worn at a prescribed position of a head area of a listener. The prescribed position is a position allowing the listener to feel that a sound source moves from a position to which the bone conduction device is attached and to feel the sound source from another position.

15 Claims, 23 Drawing Sheets

(51) Int. Cl.

| | |
|---|---|
| ***H04R 1/10*** | (2006.01) |
| ***H04R 5/04*** | (2006.01) |
| ***H04S 7/00*** | (2006.01) |
| *H04S 1/00* | (2006.01) |
| *H04S 3/00* | (2006.01) |

(56) References Cited

FOREIGN PATENT DOCUMENTS

| | | | |
|---|---|---|---|
| JP | 2008-227806 | A | 9/2008 |
| JP | 2009-069219 | A | 4/2009 |
| WO | 2012/063423 | A1 | 5/2012 |

* cited by examiner

AUDIO PLAYBACK DEVICE

CROSS REFERENCE TO RELATED APPLICATIONS

This application is a U.S. National Phase of International Patent Application No. PCT/JP2015/073822 filed on Aug. 25, 2015, which claims priority benefit of Japanese Patent Application No. JP 2014-213795 filed in the Japan Patent Office on Oct. 20, 2014, and also claims priority benefit of Japanese Patent Application No. JP 2015-021401 filed in the Japan Patent Office on Feb. 5, 2015. Each of the above-referenced applications is hereby incorporated herein by reference in its entirety.

TECHNICAL FIELD

The present disclosure relates to an audio playback device.

BACKGROUND ART

There is known a bone conduction speaker for hearing a bone conduction sound being sound that travels by vibrations of bone. The bone conduction speaker is generally configured so that a listener can hear a playback sound by attaching a vibrating portion to the vicinity of a temple etc. and listening to the bone conduction sound generated on the basis of the vibration of the vibrating portion.

CITATION LIST

Patent Literature

Patent Literature 1: WO 2012/63423

DISCLOSURE OF INVENTION

Technical Problem

A bone conduction speaker allows listening of a bone conduction sound without wearing of a speaker portion at an ear position. When such characteristic of a bone conduction speaker is taken into account, it is considered possible to realize a novel listening experience for a listener.

Accordingly, in the present disclosure, a new and improved audio playback device is proposed, which allows a novel listening experience for a listener by bone conduction from a prescribed position of the head area.

Solution to Problem

According to the present disclosure, there is provided an audio playback device including at least one bone conduction device. The bone conduction device is provided at a position to be worn at a prescribed position of a head area of a listener. The prescribed position is a position allowing the listener to feel that a sound source moves from a position to which the bone conduction device is attached and to feel the sound source from another position.

Advantageous Effects of Invention

As described above, according to the present disclosure, there is provided a new and improved audio playback device that allows a novel listening experience for a listener by bone conduction from a prescribed position of the head area.

Note that the effects described above are not necessarily limitative. With or in the place of the above effects, there may be achieved any one of the effects described in this specification or other effects that may be grasped from this specification.

MODE(S) FOR CARRYING OUT THE INVENTION

Figure 1:
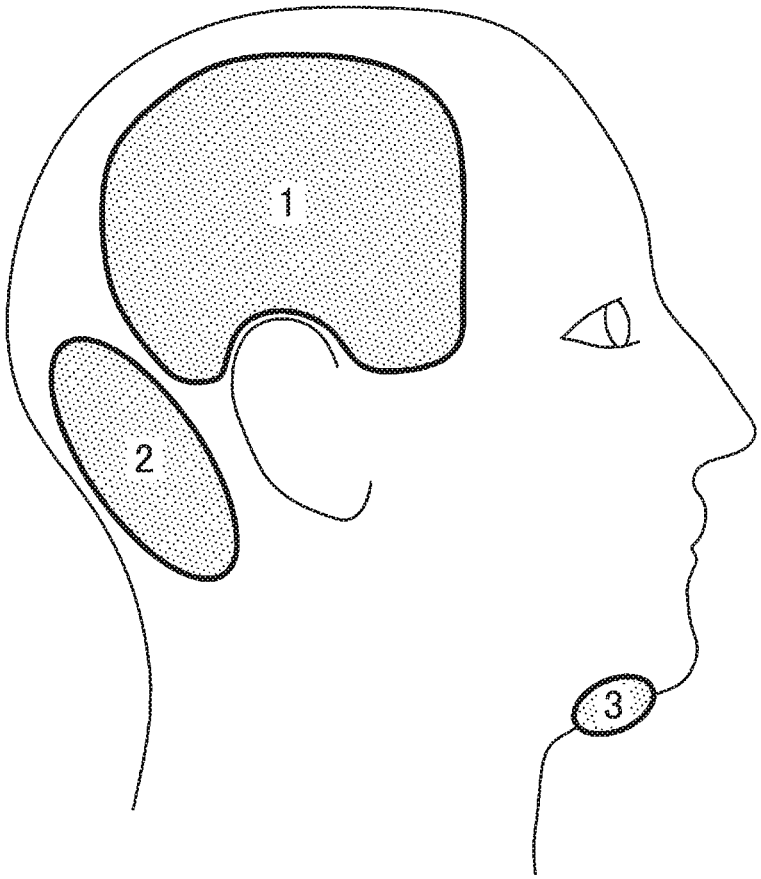
FIG. 1 is an explanatory diagram illustrating a state of the head area of man seen from the side.

Hereinafter, (a) preferred embodiment(s) of the present disclosure will be described in detail with reference to the appended drawings. In this specification and the appended drawings, structural elements that have substantially the same function and structure are denoted with the same reference numerals, and repeated explanation of these structural elements is omitted.

Note that the description will be given in the following order.

1. An embodiment of the present disclosure
   1.1. Background
   1.2. Outline
   1.3. Example of functional configuration
   1.4. Modified examples
2. Summary <1. An Embodiment of the Present Disclosure>

[1.1. Background]

Prior to detailed description of an embodiment of the present disclosure, the background of an embodiment of the present disclosure will be described, and, after that, an embodiment of the present disclosure will be described in detail.

When a listener listens to a stereo sound with a headphone or an earphone, or listens to even a monaural sound with both ears, it is a usual wearing form of a headphone or an earphone to wear the headphone or earphone in a form of covering both ears (or both ear holes). Accordingly, most of existing headphones and earphones have a form of covering both ears (or both ear holes).

That most of existing headphones and earphones have such a form of covering both ears (or both ear holes) means that there is a restriction in the design of headphones and earphones.

As described above, there is known an existence of a bone conduction speaker for hearing a bone conduction sound being sound that travels by vibrations of bone. In the bone conduction speaker, a listener generally attaches a vibration portion (in descriptions below, it is also called a vibration applying unit) to a prescribed position of the head area, such as the vicinity of a temple, and listens to a bone conduction sound generated on the basis of the vibration of the vibration portion. It is so configured that the listener can hear the playback sound by listening to the bone conduction sound.

The bone conduction speaker has such a characteristic as allowing a sound to be listened to without attaching a vibration portion to an ear, and, therefore, it is considered possible to increase the degree of freedom in design of headphones and earphones by taking advantage of the characteristic. However, existing headphones equipped with a bone conduction speaker is configured so that the vibration portion is located near an ear and is not necessarily said to be suitable from the viewpoint of usability of a sense of release and degree of freedom in design, etc.

Therefore, the present disclosing party studied hard about technologies capable of realizing a novel listening experience for listeners, in consideration of the above-described characteristic of the bone conduction speaker. Then, the present disclosing party thought up such an audio playback device as shown below capable of detecting sounds from both ears in accordance with the wearing position of a vibration portion.

Hereinbefore, the background of an embodiment of the present disclosure is described in detail. Next, the outline of an embodiment of the present disclosure will be described.

[1.2. Outline]

A bone conduction speaker is used for listening to a bone conduction sound generated on the basis of the vibration of a vibration portion. The present disclosing party examined about a region of the head area of man effective for attaching the vibration portion upon applying an embodiment of the present disclosure. As the result, the present disclosing party paid attention to the existence of a position, depending on a wearing position of the vibration portion onto the head area of man, that caused a sound to be heard as if the sound was not emitted near the wearing position but was emitted in a place apart from the wearing position.

FIG. 1 is an explanatory diagram illustrating a state of the head area of man seen from the side, and is a diagram for explaining regions that allow a sound to be often perceived, moving from the position to which the vibration portion of a bone conduction speaker is attached. An area 1 and an area 2 in FIG. 1 are areas that were known from the examination of the present disclosing party that they often allowed a sound to be perceived in places apart from the position to which the vibration portion of a bone conduction speaker was attached. The area 1 is an area located around a side head area and above an ear, and an area located around the side head area and closer to a parietal region from above an auricle. The area 2 is an area closer to an occipital region than the aforementioned area 1.

It was known from the examination of the present disclosing party that, when the vibration portion of a bone conduction speaker is attached to any place in the area 1 and the area 2 illustrated in FIG. 1, the listener hears as if a sound is emitted from a place apart from the position to which the vibration portion of a bone conduction speaker is attached, for example, at the central portion in the head or a place located on the opposite side of the head area.

Accordingly, with a configuration in which the vibration portion of a bone conduction speaker is located in the area 1 or the area 2 illustrated in FIG. 1, it is possible to realize an audio playback device including a bone conduction speaker that may effectively transmit a sound to a listener and provide a novel listening experience to the listener.

Meanwhile, it is known from the examination of the present disclosing party that, when the vibration portion of a bone conduction speaker is attached to the lower jaw shown by an area 3 in FIG. 1, too, the listener hears as if a sound is emitted in a place apart from the position to which the vibration portion of the bone conduction speaker is attached. Accordingly, with a configuration in which the vibration portion of a bone conduction speaker is located in the area 3 illustrated in FIG. 1, it is possible to realize an audio playback device including a bone conduction speaker that may effectively transmit a sound to a listener and provide a novel listening experience to the listener.

On the other hand, there also exists such an area that, even when the vibration portion of a bone conduction speaker is attached to the area, a sound is heard as if emitted near the wearing position.

Figure 2:
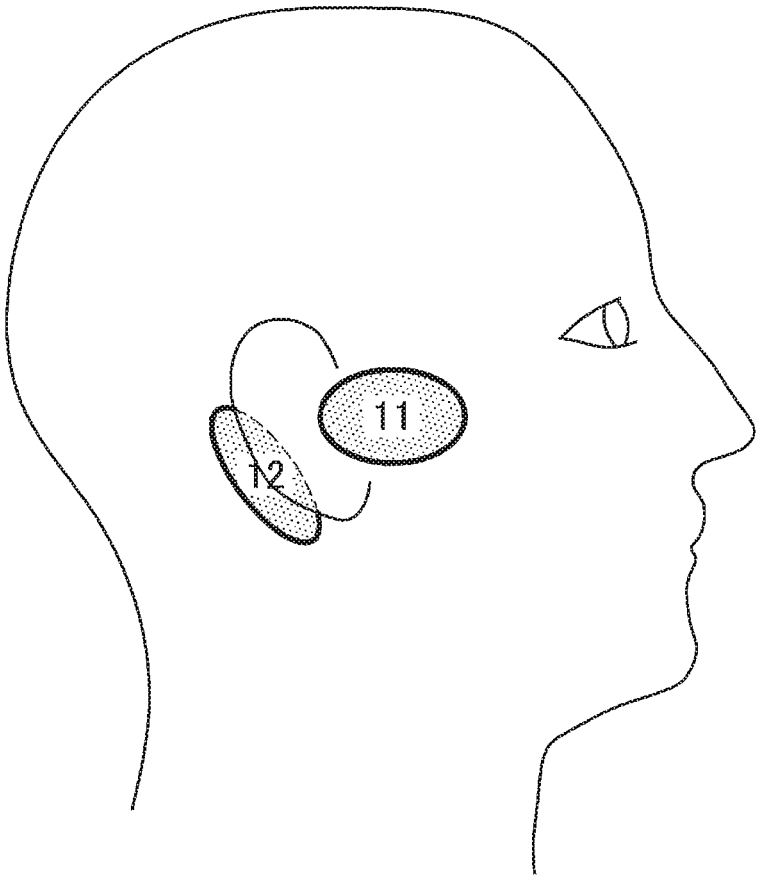
FIG. 2 is an explanatory diagram illustrating a state of the head area of man seen from the side.

FIG. 2 is an explanatory diagram illustrating a state of the head area of man seen from the side, and is a diagram for explaining regions in which sounds are perceived at a position to which the vibration portion of a bone conduction speaker is attached, or near the position in many cases. An area 11 and an area 12 in FIG. 2 are areas about which it was known by the examination of the present disclosing party that sounds were perceived at a position to which the vibration portion of a bone conduction speaker was attached, or near the position in many cases. The area 11 is an area located directly in front of the auricle. The area 12 is an area near the rear of the auricle.

It was known from the examination of the present disclosing party that, when the vibration portion of a bone conduction speaker was attached to any place in the area 11 or the area 12 illustrated in FIG. 2, sounds were heard as if they were emitted at a position to which the vibration portion of the bone conduction speaker was attached, or near the position.

Accordingly, it is possible to realize an audio playback device including a bone conduction speaker and capable of allowing a listener to listen to sounds from various directions even when the vibration portion of a bone conduction speaker is provided on one side of the head, by considering the above-described area for a setting place of the vibration portion of a bone conduction speaker. Meanwhile, concrete examples of audio playback devices including a bone conduction speaker will be described below in detail.

Hereinbefore, the outline of an embodiment of the present disclosure is described. Next, there will be described examples of functional configurations of the audio playback device according to an embodiment of the present disclosure.

[1.3. Example of Functional Configuration]

(1) Listening of Monaural Sound (Bone Conduction Sound Alone)

As the first example, there will be described an example of functional configuration of an audio playback device according to an embodiment of the present disclosure in a case that a listener is caused to listen to a monaural sound by a bone conduction sound.

Figure 3:
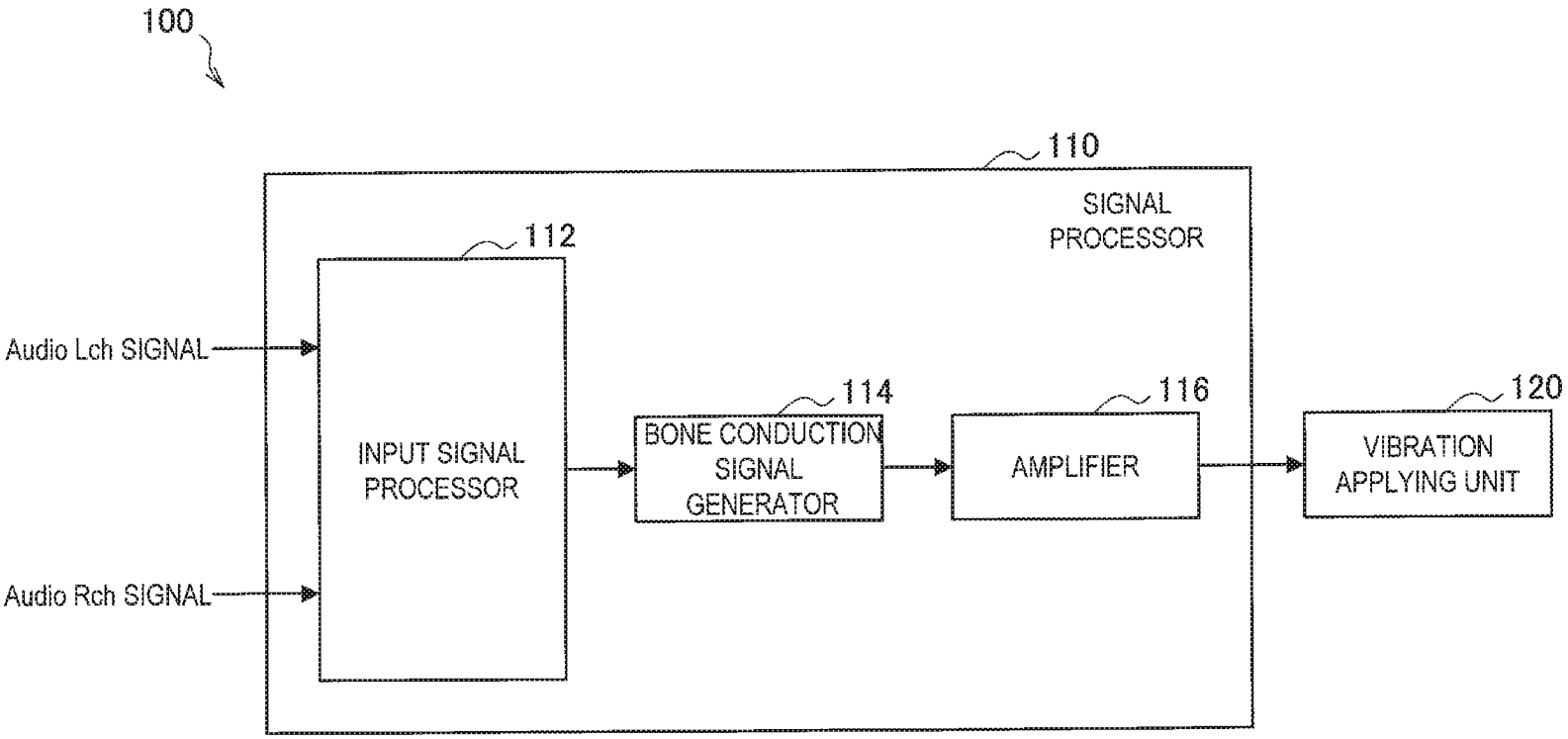
FIG. 3 is an explanatory diagram illustrating an example of a functional configuration of an audio playback device 100.

FIG. 3 is an explanatory diagram illustrating an example of functional configuration of an audio playback device 100 according to an embodiment of the present disclosure. Hereinafter, an example of functional configuration of the audio playback device 100 according to an embodiment of the present disclosure will be described by use of FIG. 3.

As illustrated in FIG. 3, the audio playback device 100 according to an embodiment of the present disclosure includes a signal processor 110 and a vibration applying unit 120.

The signal processor 110 performs signal processing of an audio signal, and outputs the processed signal to the vibration applying unit 120. The signal processor 110 illustrated in FIG. 3 performs signal processing for outputting a sound, for example, based on a 2-channel audio signal from the vibration applying unit 120 being an output device.

As illustrated in FIG. 3, the signal processor 110 included in the audio playback device 100 according to an embodiment of the present disclosure includes an input signal processor 112, a bone conduction signal generator 114 and an amplifier 116.

The input signal processor 112 performs signal processing of synthesizing a 2-channel (L channel and R channel) audio signal to a 1-channel audio signal. The input signal processor 112 outputs the 1-channel audio signal to the bone conduction signal generator 114.

The bone conduction signal generator 114 performs various types of signal processing on the 1-channel audio signal when the sound is output from the vibration applying unit 120 so that a listener may satisfactorily listen to the sound. The bone conduction signal generator 114 outputs a 1-channel audio signal having been subjected to various types of signal processing to the amplifier 116.

For example, the bone conduction signal generator 114 performs such processing as correction of frequency or correction of phase on the 1-channel audio signal. Examples of the correction processing of frequency include such processing as lowering of a high register or amplification of a midrange and low register. Examples of the correction processing of phase include such processing as correction of phase shift at different frequencies.

Depending on wearing positions of the vibration applying unit 120, there are regions such as a region where high-pitched sounds are perceived easily and a region where sounds are perceived with good balance. Accordingly, the bone conduction signal generator 114 may be configured so as to perform suitable signal processing on a 1-channel audio signal in accordance with a wearing position of the vibration applying unit 120.

The amplifier 116 amplifies the 1-channel audio signal output from the bone conduction signal generator 114 by a prescribed amount and outputs the signal. For the vibration applying unit 120 that presents a bone conduction sound, a drive voltage that is higher than a drive voltage at an ordinary headphone terminal may be required, and, in this case, an exclusive amplifier is desirably provided in the previous stage of the vibration applying unit 120. The amplifier 116 outputs the amplified 1-channel audio signal to the vibration applying unit 120.

The whole of the signal processor 110 may be configured as a unit, or blocks in and after the input signal processor 112 may be configured as a unit. Further, when the audio playback device 100 has a sunglass-like shape as will be described later, all blocks including the vibration applying unit 120 may be configured as a unit.

The vibration applying unit 120 presents a bone conduction sound to a user on the basis of the 1-channel audio signal output from the signal processor 110. The vibration applying unit 120 can present a bone conduction sound to a user on the basis of the audio signal from the signal processor 110, by being worn in the head area of the user, for example, the area shown by the area 1 or the area 2 in FIG. 1.

The audio playback device 100 according to an embodiment of the present disclosure can present a bone conduction sound to a listener by having the configuration illustrated in FIG. 3. The vibration applying unit 120 has such a form to be worn in the head area of a user, for example, an area shown by the area 1 or the area 2 in FIG. 1 described above, and thus the audio playback device 100 according to an embodiment of the present disclosure can allow a listener to detect as if the sound is emitted not in the area but in a place different from the area, for example, at the central portion in the head.

Hereinbefore, there is described the example of functional configuration of the audio playback device 100 according to an embodiment of the present disclosure when a listener is caused to listen to a monaural sound by a bone conduction sound. Next, there will be described an example of appearance of the audio playback device 100 according to an embodiment of the present disclosure when a listener is caused to listen to a monaural sound by a bone conduction sound.

Figure 4:
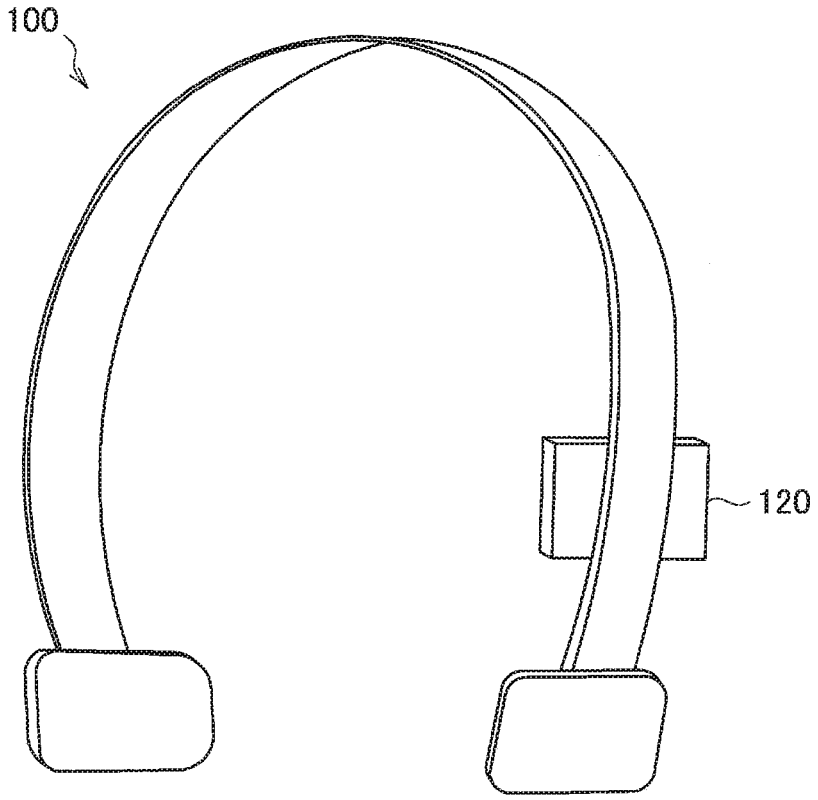
FIG. 4 is an explanatory diagram illustrating an appearance example of the audio playback device 100.

FIG. 4 is an explanatory diagram illustrating an example of appearance of the audio playback device 100 according to an embodiment of the present disclosure when a listener is caused to listen to a monaural sound by a bone conduction sound. FIG. 4 illustrates an example of appearance of the audio playback device 100 according to an embodiment of the present disclosure in a form of an overhead type, when a listener is caused to listen to a monaural sound by a bone conduction sound.

In the audio playback device 100 illustrated in FIG. 4, the vibration applying unit 120 is provided so as to be worn in the area 1 in FIG. 1. The vibration applying unit 120 is provided in this way and a monaural bone conduction sound is presented from the vibration applying unit 120, and thus the audio playback device 100 according to an embodiment of the present disclosure can allow the listener to detect as if the sound is emitted not in the vicinity of the area 1 but in a place different from the area 1, for example, at the central portion in the head.

Figure 5:
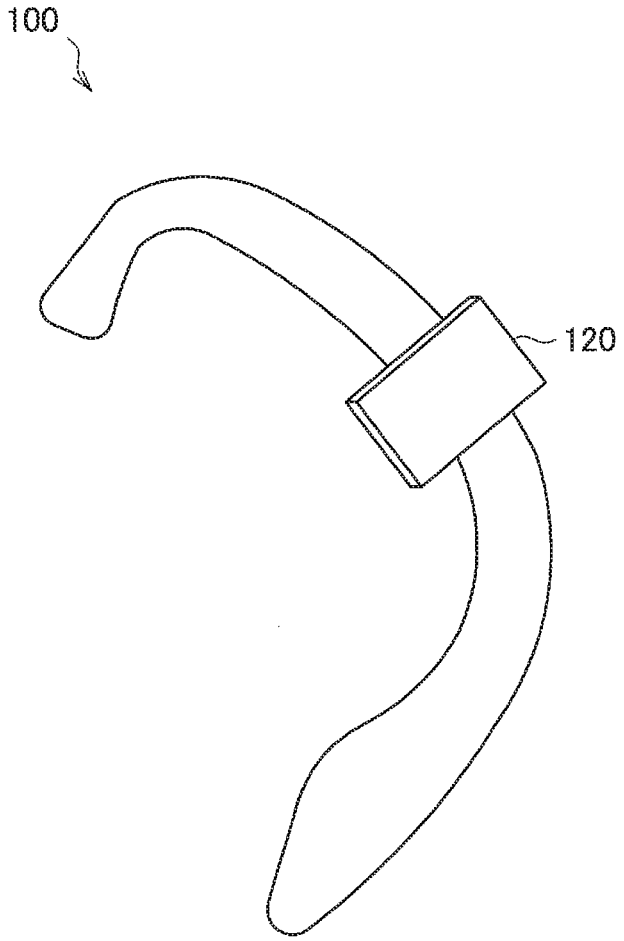
FIG. 5 is an explanatory diagram illustrating an appearance example of the audio playback device 100.

Another example of appearance of the audio playback device 100 will be shown. FIG. 5 is an example of appearance of the audio playback device 100 according to an embodiment of the present disclosure in a form of an ear-hook type, when a listener is caused to listen to a monaural sound by a bone conduction sound.

In the audio playback device 100 illustrated in FIG. 5, the vibration applying unit 120 is provided so as to be worn in the area 1 in FIG. 1. The vibration applying unit 120 is provided in this way and a monaural bone conduction sound is presented from the vibration applying unit 120, and thus the audio playback device 100 according to an embodiment of the present disclosure can allow the listener to detect as if the sound is emitted not in the vicinity of the area 1 but in a place different from the area 1, for example, at the central portion in the head.

Figure 6:
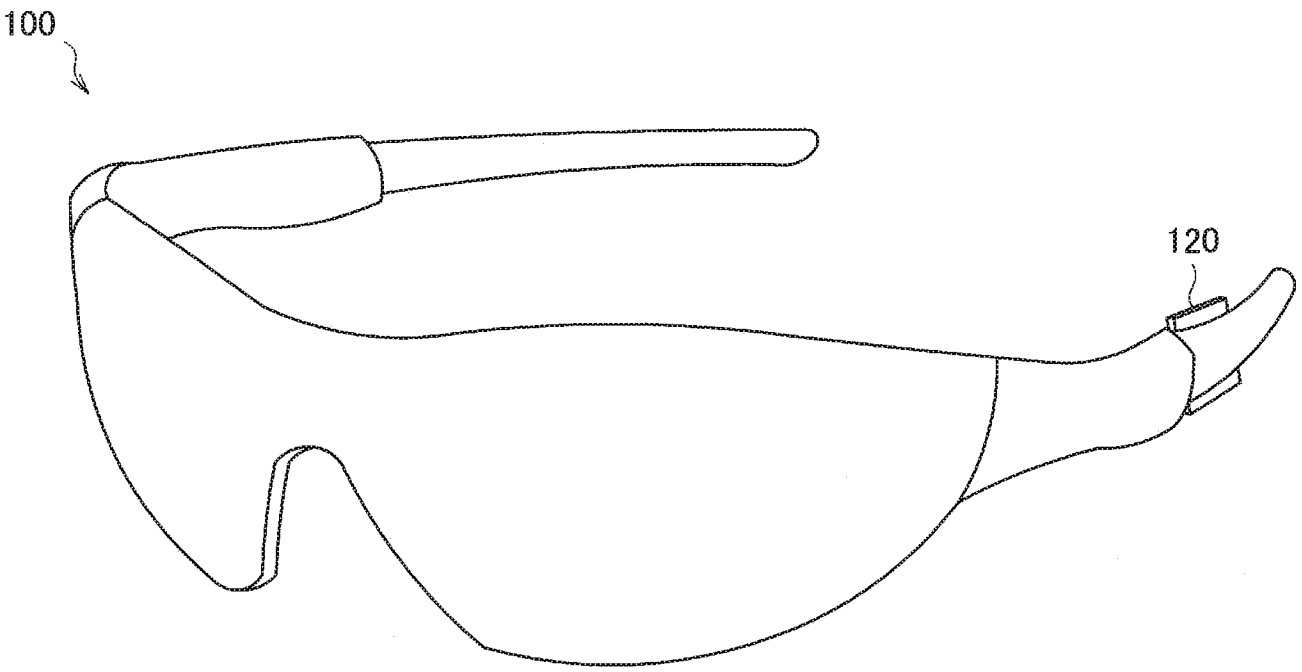
FIG. 6 is an explanatory diagram illustrating an appearance example of the audio playback device 100.

Another example of appearance of the audio playback device 100 will be shown. FIG. 6 is an example of appearance of the audio playback device 100 according to an embodiment of the present disclosure in a form of a sunglass type, when a listener is caused to listen to a monaural sound by a bone conduction sound.

In the audio playback device 100 illustrated in FIG. 6, the vibration applying unit 120 is provided so as to be worn in the area 1 in FIG. 1. The vibration applying unit 120 is provided in this way and a monaural bone conduction sound is presented from the vibration applying unit 120, and thus the audio playback device 100 according to an embodiment of the present disclosure can allow the listener to detect as if the sound is emitted not in the vicinity of the area 1 but in a place different from the area 1, for example, at the central portion in the head.

Hereinbefore, three examples are given to show examples of appearance of the audio playback device 100 according to an embodiment of the present disclosure, but, needless to say, the appearance of the audio playback device 100 according to an embodiment of the present disclosure is not limited to these examples, and, needless to say, also the wearing place of the vibration applying unit 120 may be not the area 1 in FIG. 1 but, for example, a place located in the area 2 in FIG. 1.

(2) Listening of Stereo Sounds (Air Conduction Sound and Bone Conduction Sound)

As a next example, there will be described an example of functional configuration of an audio playback device according to an embodiment of the present disclosure when a listener is caused to listen to stereo sounds by an air conduction sound and a bone conduction sound.

Figure 7:
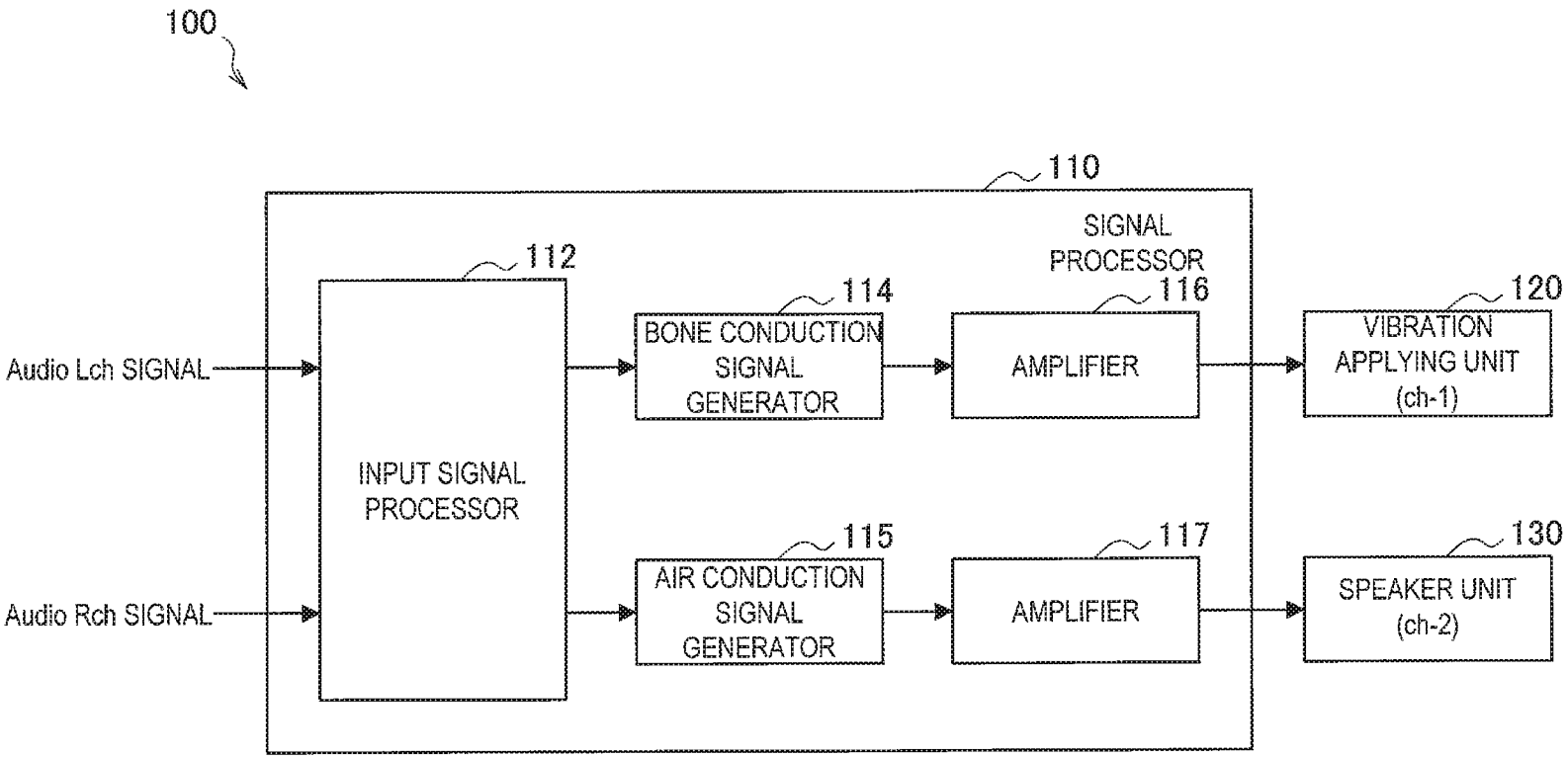
FIG. 7 is an explanatory diagram illustrating an example of a functional configuration of an audio playback device 100.

FIG. 7 is an explanatory diagram illustrating an example of functional configuration of the audio playback device 100 according to an embodiment of the present disclosure. Hereinafter, an example of functional configuration of the audio playback device 100 according to an embodiment of the present disclosure will be described by use of FIG. 7.

As illustrated in FIG. 7, the audio playback device 100 according to an embodiment of the present disclosure includes the signal processor 110, the vibration applying unit 120 and a speaker unit 130.

The signal processor 110 performs signal processing of an audio signal and outputs the processed signal to the vibration applying unit 120 and the speaker unit 130. The signal processor 110 illustrated in FIG. 7 performs signal processing for outputting, for example, sounds by 2-channel audio signal from the vibration applying unit 120 and the speaker unit 130.

As illustrated in FIG. 7, the signal processor 110 included in the audio playback device 100 according to an embodiment of the present disclosure includes the input signal processor 112, the bone conduction signal generator 114, an air conduction signal generator 115 and amplifiers 116 and 117.

The input signal processor 112 performs signal processing on 2-channel (L channel and R channel) audio signals to distribute the 2-channel audio signals to a sound to be output from the vibration applying unit 120 and a sound to be output from the speaker unit 130. The input signal processor 112 outputs the 2-channel audio signals to the bone conduction signal generator 114 and the air conduction signal generator 115, respectively.

The bone conduction signal generator 114 performs various types of signal processing on the audio signal sent from the input signal processor 112 so that a listener may satisfactorily listen to sounds when the vibration applying unit 120 outputs sounds. The bone conduction signal generator 114 outputs the audio signal having been subjected to various types of signal processing to the amplifier 116.

For example, the bone conduction signal generator 114 performs such processing as correction of frequency or correction of phase on the audio signal output from the input signal processor 112. Examples of the correction processing of frequency include such processing as lowering of a high register or amplification of a midrange and low register. Examples of the correction processing of phase include such processing as correction of phase shift at different frequencies. Examples of adjustment processing of delay include such processing as correction of shift in a time-axis direction such as shift caused by the difference in communication channels between bone conduction and air conduction.

The air conduction signal generator 115 performs various types of signal processing on the audio signal sent from the input signal processor 112 so that a listener may satisfactorily listen to sounds when sounds are output from the speaker unit 130. The air conduction signal generator 115 outputs the audio signal having been subjected to various types of signal processing to the amplifier 117.

For example, the air conduction signal generator 115 performs such processing as correction of frequency or correction of phase on the audio signal output from the input signal processor 112. Examples of the correction processing of frequency include such processing as lowering of a high register or amplification of a midrange and low register. Examples of the correction processing of phase include such processing as correction of phase shift at different frequencies. Examples of adjustment processing of delay include such processing as correction of shift in the time-axis direction such as shift caused by the difference in communication channels between bone conduction and air conduction.

The amplifier 116 amplifies the audio signal output from the bone conduction signal generator 114 by a prescribed amount and outputs the signal. The amplifier 116 outputs the amplified audio signal to the vibration applying unit 120. In the same way, the amplifier 117 amplifies the audio signal output from the bone conduction signal generator 114 by a prescribed amount and outputs the signal. The amplifier 117 outputs the amplified audio signal to the speaker unit 130. Meanwhile, the amplification amount by the amplifier 116 and the amplification amount by the amplifier 117 may be different from each other.

The vibration applying unit 120 presents a bone conduction sound to a user on the basis of the audio signal output from the signal processor 110. The vibration applying unit 120 is worn in the head area of a user, for example, an area shown by the area 1 or the area 2 in FIG. 1 described above, and thus can present a bone conduction sound to the user on the basis of the audio signal from the signal processor 110.

The speaker unit 130 presents an air conduction sound to a user on the basis of the audio signal output from the signal processor 110. The position of the speaker unit 130 is desirably provided on the same side as the position of the vibration applying unit 120 in the head area of a listener.

The vibration applying unit 120 and the speaker unit 130 are provided on the same side of the head area of a listener, and thus the audio playback device 100 according to an embodiment of the present disclosure illustrated in FIG. 7 may allow the listener to listen to sounds from various directions, even when the vibration portion of a bone conduction speaker is provided only on one side of the head.

Further, the vibration applying unit 120 and the speaker unit 130 are provided on the same side in the head area of a listener, and thus the audio playback device 100 according to an embodiment of the present disclosure illustrated in FIG. 7 exerts such an effect as excellent design properties, too.

Hereinbefore, there are described examples of functional configuration of the audio playback device 100 according to an embodiment of the present disclosure when a listener is caused to listen to stereo sounds by an air conduction sound and a bone conduction sound. Next, there will be described examples of appearance of the audio playback device 100 according to an embodiment of the present disclosure when a listener is caused to listen to stereo sounds by an air conduction sound and a bone conduction sound.

Figure 8:
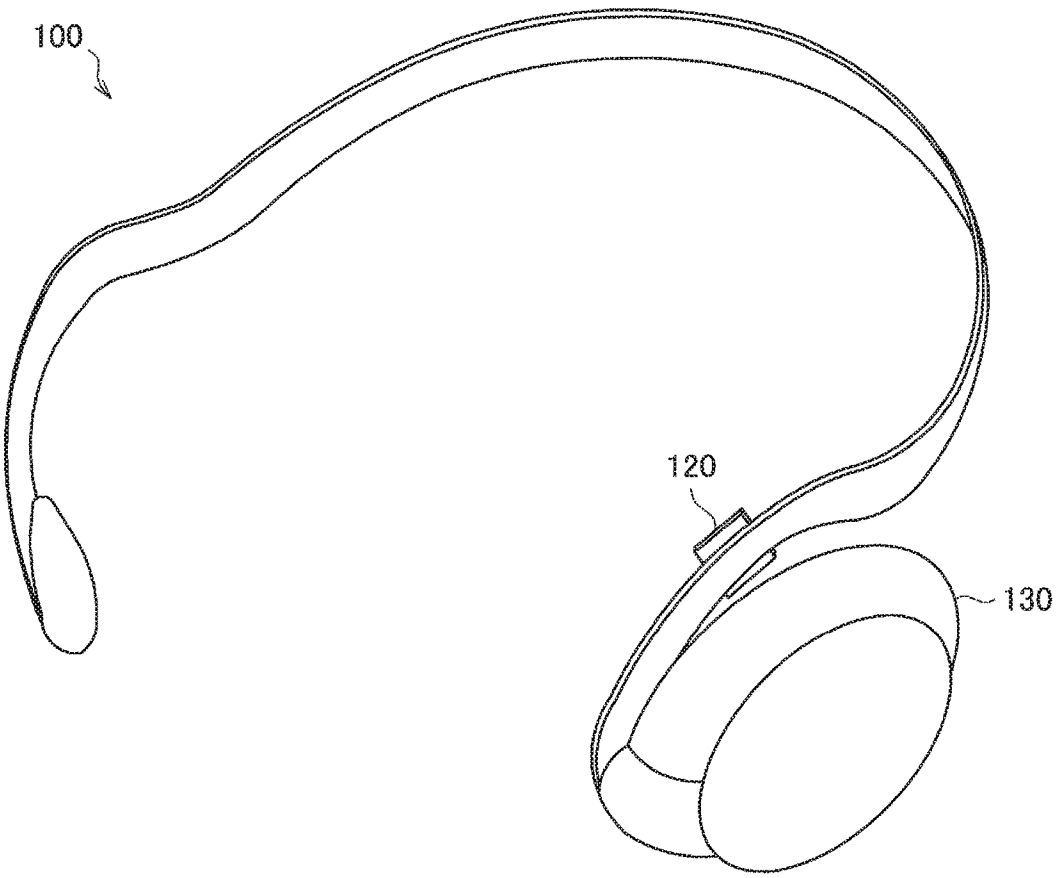
FIG. 8 is an explanatory diagram illustrating an appearance example of the audio playback device 100.

FIG. 8 is an explanatory diagram illustrating an example of appearance of the audio playback device 100 according to an embodiment of the present disclosure. FIG. 8 illustrates an example of appearance of the audio playback device 100 according to an embodiment of the present disclosure in a form of a neckband type (a form having such a structure as sandwiching the head from both sides) when a listener is caused to listen to stereo sounds by an air conduction sound and a bone conduction sound.

In the audio playback device 100 illustrated in FIG. 8, the vibration applying unit 120 is provided so as to be worn in the area 1 in FIG. 1. Further, the speaker unit 130 is provided on the same side (in the example in FIG. 8, the left side of the head area of a listener) as the side on which the vibration applying unit 120 is provided. The vibration applying unit 120 and the speaker unit 130 are provided in this way and a bone conduction sound is presented from the vibration applying unit 120 and an air conduction sound is presented from the speaker unit 130, and thus the audio playback device 100 according to an embodiment of the present disclosure can allow the listener to detect as if sounds are not emitted on one side of the head area but stereo sounds are emitted.

Figure 9:
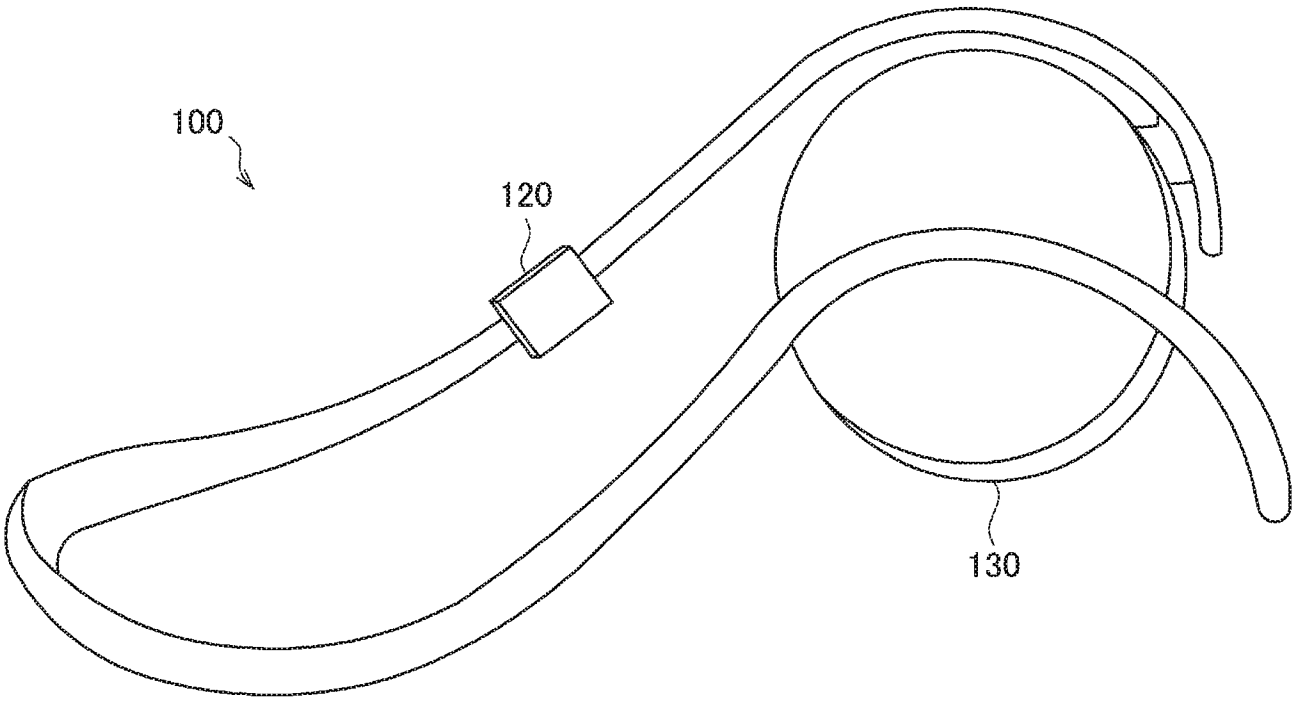
FIG. 9 is an explanatory diagram illustrating an appearance example of the audio playback device 100.

Another example of appearance of the audio playback device 100 will be shown. FIG. 9 is an explanatory diagram illustrating an example of appearance of the audio playback device 100 according to an embodiment of the present disclosure. FIG. 9 illustrates an example of appearance of the audio playback device 100 according to an embodiment of the present disclosure in a form of a neckband type (a form having such a structure as sandwiching the head from both sides) when a listener is caused to listen to stereo sounds by an air conduction sound and a bone conduction sound.

In the audio playback device 100 illustrated in FIG. 9, the vibration applying unit 120 is provided so as to be worn in the area 2 in FIG. 1. Further, the speaker unit 130 is provided on the same side (in the example in FIG. 9, the left side of the head area of a listener) as the side on which the vibration applying unit 120 is provided.

The vibration applying unit 120 and the speaker unit 130 are provided as illustrated in FIG. 9 and a bone conduction sound is presented from the vibration applying unit 120 and an air conduction sound is presented from the speaker unit 130, and thus the audio playback device 100 according to an embodiment of the present disclosure can allow a listener to detect as if sounds are not emitted on one side of the head area but stereo sounds are emitted.

Figure 10:
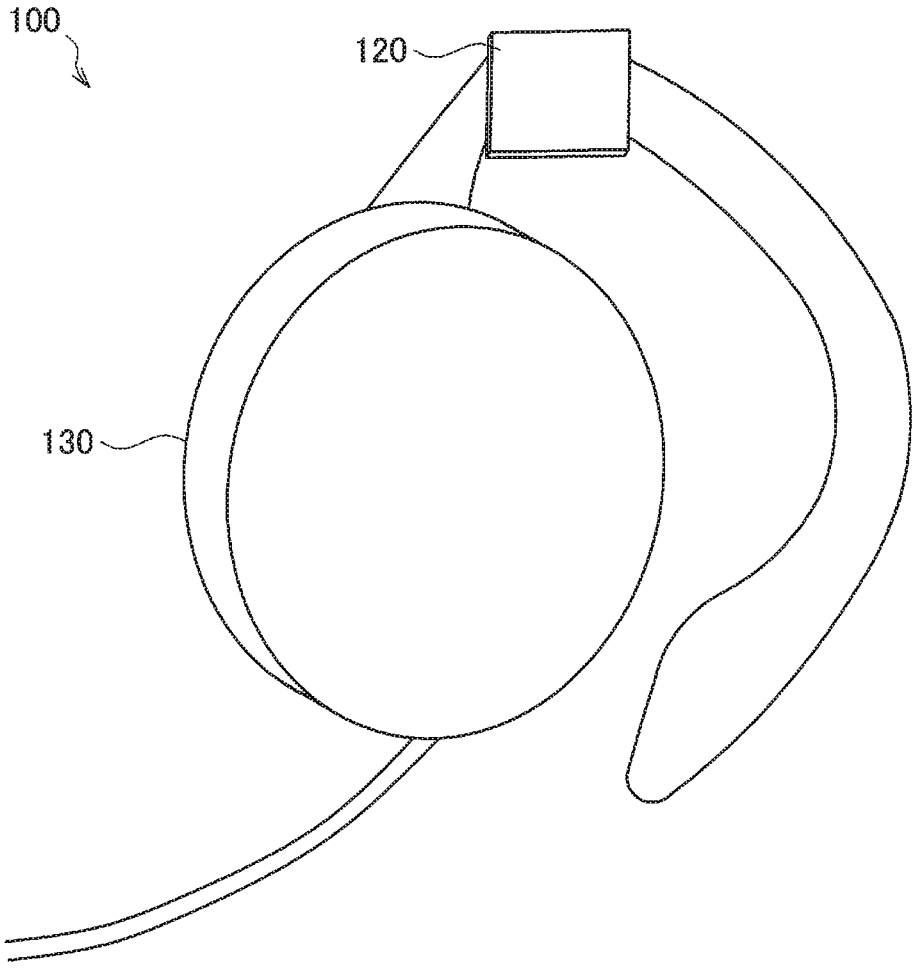
FIG. 10 is an explanatory diagram illustrating an appearance example of the audio playback device 100.

Another example of appearance of the audio playback device 100 will be shown. FIG. 10 is an explanatory diagram illustrating an example of appearance of the audio playback device 100 according to an embodiment of the present disclosure. FIG. 10 illustrates an example of appearance of the audio playback device 100 according to an embodiment of the present disclosure in a form of an ear-hook type when a listener is caused to listen to stereo sounds by an air conduction sound and a bone conduction sound.

In the audio playback device 100 illustrated in FIG. 10, the vibration applying unit 120 is provided so as to be worn in the area 1 in FIG. 1. Further, the speaker unit 130 presenting an air conduction sound to a listener is provided on the same side (in the example in FIG. 10, the right side of the head area of a listener) as the side on which the vibration applying unit 120 is provided.

The vibration applying unit 120 and the speaker unit 130 are provided as illustrated in FIG. 10 and a bone conduction sound is presented from the vibration applying unit 120 and an air conduction sound is presented from the speaker unit 130, and thus the audio playback device 100 according to an embodiment of the present disclosure can allow a listener to detect as if sounds are not emitted on one side of the head area but stereo sounds are emitted.

Figure 11:
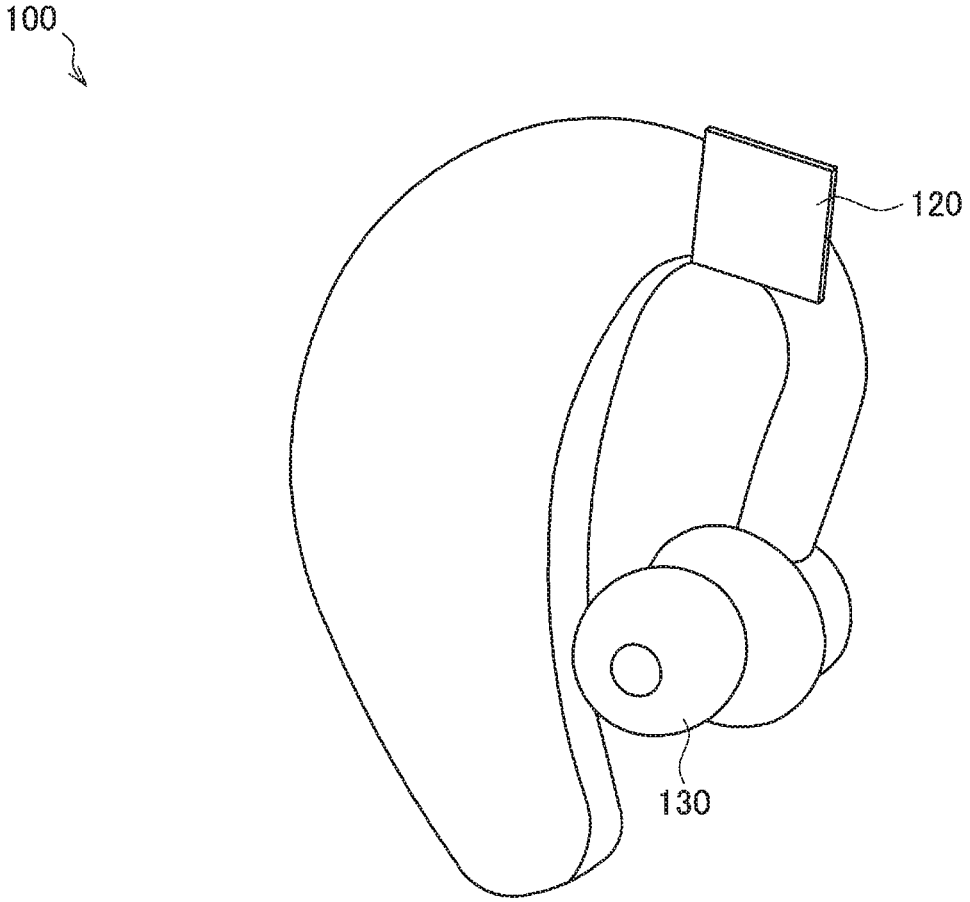
FIG. 11 is an explanatory diagram illustrating an appearance example of the audio playback device 100.

Another example of appearance of the audio playback device 100 will be shown. FIG. 11 is an explanatory diagram illustrating an example of appearance of the audio playback device 100 according to an embodiment of the present disclosure. FIG. 11 illustrates an example of appearance of the audio playback device 100 according to an embodiment of the present disclosure in a form of an ear-hook type when a listener is caused to listen to stereo sounds by an air conduction sound and a bone conduction sound.

In the audio playback device 100 illustrated in FIG. 11, the vibration applying unit 120 is provided so as to be worn in the area 1 in FIG. 1. Further, the speaker unit 130 of a canal type is provided on the same side (in the example in FIG. 11, the left side of the head area of a listener) as the side on which the vibration applying unit 120 is provided.

The vibration applying unit 120 and the speaker unit 130 are provided as illustrated in FIG. 11 and a bone conduction sound is presented from the vibration applying unit 120 and an air conduction sound is presented from the speaker unit 130, and thus the audio playback device 100 according to an embodiment of the present disclosure can allow a listener to detect as if sounds are not emitted on one side of the head area but stereo sounds are emitted.

Figure 12:
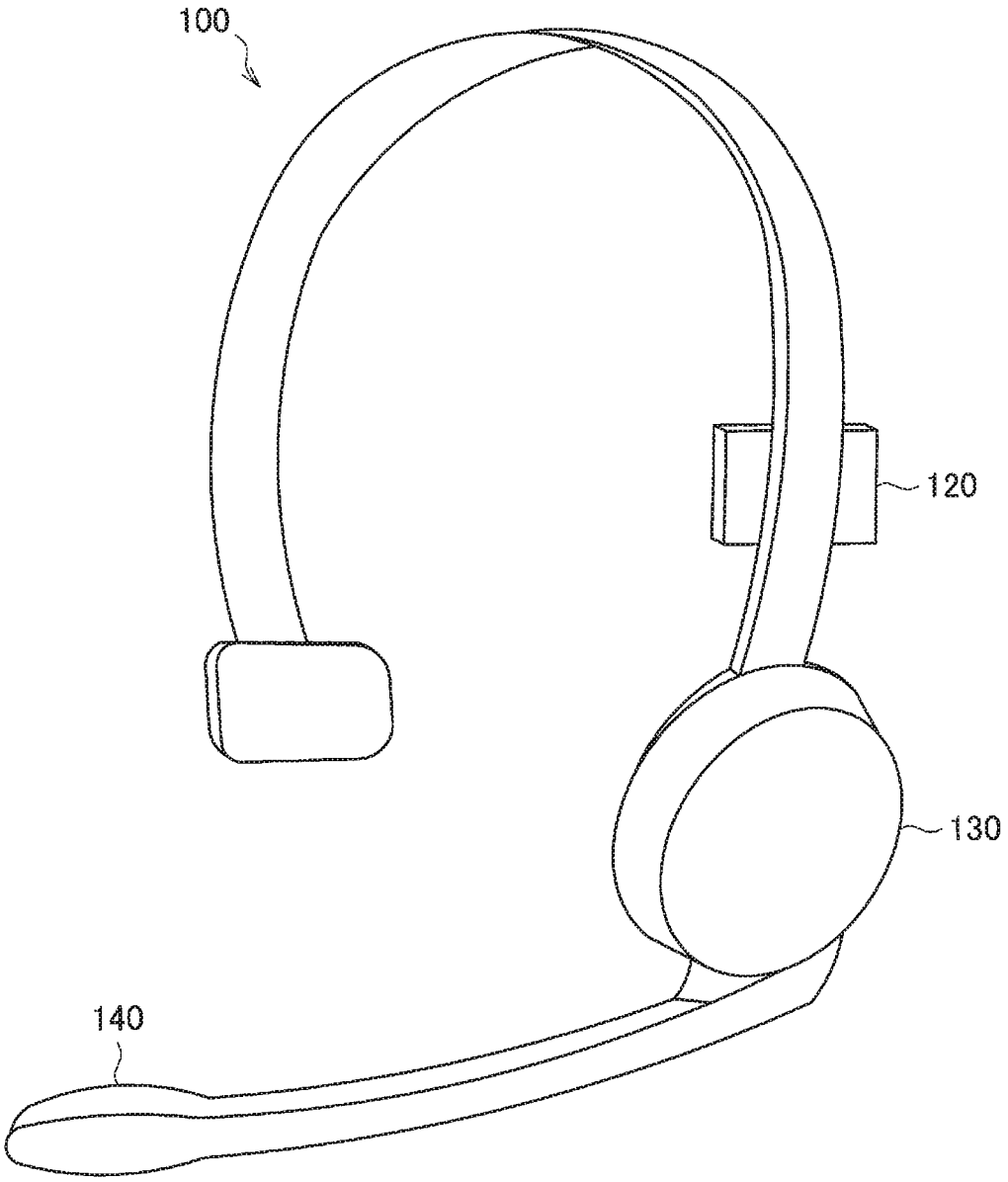
FIG. 12 is an explanatory diagram illustrating an appearance example of the audio playback device 100.

Another example of appearance of the audio playback device 100 will be shown. FIG. 12 is an explanatory diagram illustrating an example of appearance of the audio playback device 100 according to an embodiment of the present disclosure. FIG. 12 illustrates an example of appearance of the audio playback device 100 according to an embodiment of the present disclosure in a form of an overhead type when a listener is caused to listen to stereo sounds by an air conduction sound and a bone conduction sound.

In the audio playback device 100 illustrated in FIG. 12, the vibration applying unit 120 is provided so as to be worn in the area 1 in FIG. 1. Further, the speaker unit 130 of a canal type is provided on the same side (in the example in FIG. 12, the left side of the head area of a listener) as the side on which the vibration applying unit 120 is provided.

The vibration applying unit 120 and the speaker unit 130 are provided as illustrated in FIG. 12 and a bone conduction sound is presented from the vibration applying unit 120 and an air conduction sound is presented from the speaker unit 130, and thus the audio playback device 100 according to an embodiment of the present disclosure can allow a listener to detect as if sounds are not emitted on one side of the head area but stereo sounds are emitted.

Meanwhile, in the audio playback device 100 illustrated in FIG. 12, a microphone 140 collecting the voice of a listener is also provided. When a listener speaks in a state of wearing the audio playback device 100 in the head area, contents of the speech are collected with the microphone 140. With the audio playback device 100 illustrated in FIG. 12, it is possible for a listener to favorably listen to sounds by the vibration applying unit 120 and the speaker unit 130 while speaking toward the microphone 140, by wearing the audio playback device 100 illustrated in FIG. 12 in the head area.

It is unnecessary to limit the audio playback device 100 illustrated in FIG. 12 to cause a listener to listen to stereo sounds by the vibration applying unit 120 and the speaker unit 130. When the microphone 140 is provided as illustrated in FIG. 12, the audio playback device 100 may control outputs of sounds from the vibration applying unit 120 and the speaker unit 130 so as to allow a listener to listen to sounds at the central part in the head of the listener.

(3) Listening of Stereo Sounds (Bone Conduction Sound)

As a next example, there will be described an example of functional configuration of the audio playback device according to an embodiment of the present disclosure when a listener is caused to listen to stereo sounds by a bone conduction sound.

Figure 13:
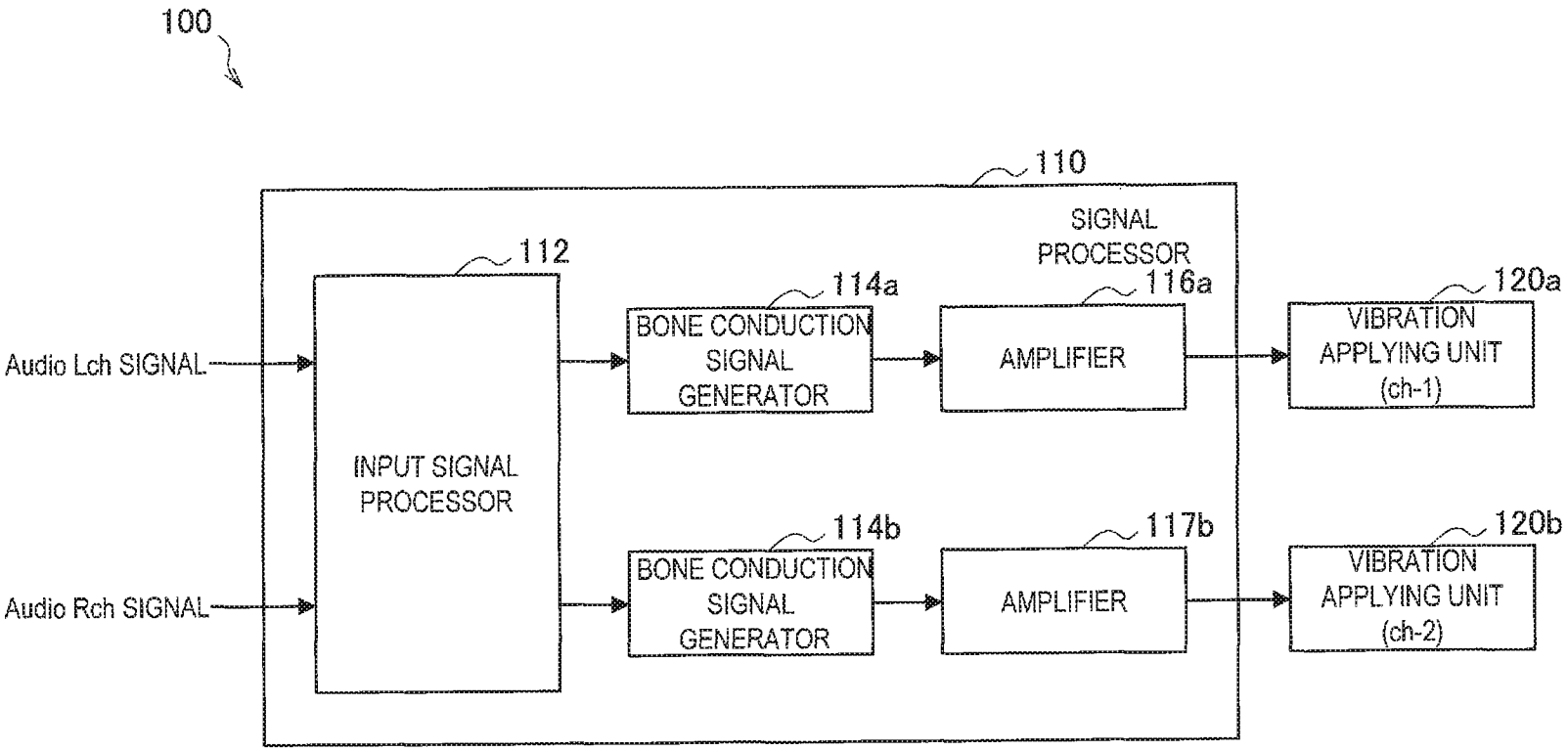
FIG. 13 is an explanatory diagram illustrating an example of a functional configuration of an audio playback device 100.

FIG. 13 is an explanatory diagram illustrating an example of functional configuration of the audio playback device 100 according to an embodiment of the present disclosure. Hereinafter, an example of functional configuration of the audio playback device 100 according to an embodiment of the present disclosure will be described by use of FIG. 13.

As illustrated in FIG. 13, the audio playback device 100 according to an embodiment of the present disclosure includes the signal processor 110 and vibration applying units 120*a* and 120*b*.

The signal processor 110 performs signal processing of an audio signal and outputs the processed signal to the vibration applying units 120*a* and 120*b*. The signal processor 110 illustrated in FIG. 13 performs signal processing for outputting sounds, for example, by 2-channel audio signals from the vibration applying units 120*a* and 120*b*.

As illustrated in FIG. 13, the signal processor 110 included in the audio playback device 100 according to an embodiment of the present disclosure includes the input signal processor 112, bone conduction signal generators 114*a* and 114*b*, and amplifiers 116*a* and 116*b*.

The input signal processor 112 performs signal processing on 2-channel (L channel and R channel) audio signals to distribute the 2-channel audio signals to a sound to be output from the vibration applying unit 120*a* and a sound to be output from the vibration applying unit 120*b*. The input signal processor 112 outputs the 2-channel audio signals to the bone conduction signal generators 114*a* and 114*b*, respectively.

The bone conduction signal generator 114*a* performs various types of signal processing on the audio signal sent from the input signal processor 112 so that a listener can satisfactorily listen to a sound when the sound is output from the vibration applying unit 120*a*. The bone conduction signal generator 114*a* outputs the audio signal having been subjected to various types of signal processing to the amplifier 116*a*.

In the same way, the bone conduction signal generator 114*b* performs various types of signal processing on the audio signal sent from the input signal processor 112 so that a listener can satisfactorily listen to a sound when the sound is output from the vibration applying unit 120*b*. The bone conduction signal generator 114*b* outputs the audio signal having been subjected to various types of signal processing to the amplifier 116*b*.

The bone conduction signal generators 114*a* and 114*b* perform such processing as correction of frequency or correction of phase on the audio signal output from the input signal processor 112. Examples of the correction processing of frequency include such processing as lowering of a high register or amplification of a midrange and low register. Examples of the correction processing of phase include such processing as correction of phase shift at different frequencies. Examples of adjustment processing of delay include such processing as correction of shift in the time-axis direction such as shift caused by the difference in communication channels by two bone conductions.

For example, when the vibration applying unit 120*a* is a unit for causing sounds to be detected on the opposite side of a wearing position, the bone conduction signal generator 114*a* performs signal processing of adding characteristics from a prescribed position of the head area. The other bone conduction signal generator 114*b* performs signal processing taking into account a sound leakage when the vibration applying unit 120*b* is worn near the auricle of a listener (here, the leakage means that sounds from the vibration applying unit 120*b* are listened to via air conduction). Concretely, for example, the bone conduction signal generator 114*b* performs such signal processing as giving characteristics of suppressing a high register where the sound leakage is perceived to be large.

Further, for example, the bone conduction signal generators 114*a* and 114*b* may previously have characteristics corresponding to a region where the vibration applying units 120*a* and 120*b* are worn in the head area of a listener and may apply the characteristics to signal processing on respective channels. That is, when the vibration applying unit 120*a* is a unit that causes a listener to detect sounds on the opposite side of the wearing position, the bone conduction signal generator 114*a* gives characteristics inverse to the characteristics corresponding to the region where the vibration applying unit 120*a* is worn. Further, the bone conduction signal generator 114*b* also gives characteristics inverse to the characteristics of the region where the vibration applying unit 120*b* is worn.

The bone conduction signal generators 114*a* and 114*b* may perform signal processing on an audio signal so as to give favorable characteristics to a listener, in addition to signal processing as described above.

The bone conduction signal generators 114*a* and 114*b* can allow a listener to listen to stereo sounds with a favorable expanse by performing signal processing as described above, even in a form in which the vibration applying units 120*a* and 120*b* are deviated to one side of the head area of a listener.

The amplifier 116*a* amplifies the audio signal output from the bone conduction signal generator 114*a* by a prescribed amount and outputs the signal. The amplifier 116*a* outputs the amplified audio signal to the vibration applying unit 120*a*. In the same way, the amplifier 116*b* amplifies the audio signal output from the bone conduction signal generator 114*b* by a prescribed amount and outputs the signal. The amplifier 116*b* outputs the amplified audio signal to the vibration applying unit 120*b*. Meanwhile, the amplification amount by the amplifier 116*a* and the amplification amount by the amplifier 116*b* may be different from each other.

The vibration applying unit 120*a* presents a bone conduction sound to a user on the basis of the audio signal output from the signal processor 110. The vibration applying unit 120*a* can present a bone conduction sound to a user on the basis of the audio signal from the signal processor 110, by being worn in the head area of the user, for example, in the area shown by the area 1, the area 2 in FIG. 1.

The vibration applying unit 120*b* presents a bone conduction sound to a user on the basis of the audio signal output from the signal processor 110. The vibration applying unit 120*b* is worn in the head area of the user, for example, in the area shown by the area 11, the area 12 in FIG. 2, and thus can present a bone conduction sound to a user on the basis of the audio signal from the signal processor 110.

Hereinbefore, there are described examples of functional configuration of the audio playback device 100 according to an embodiment of the present disclosure when a listener is caused to listen to stereo sounds by a bone conduction sound. Next, there will be described examples of appearance of the audio playback device 100 according to an embodiment of the present disclosure when a user is caused to listen to stereo sounds by a bone conduction sound.

Figure 14:
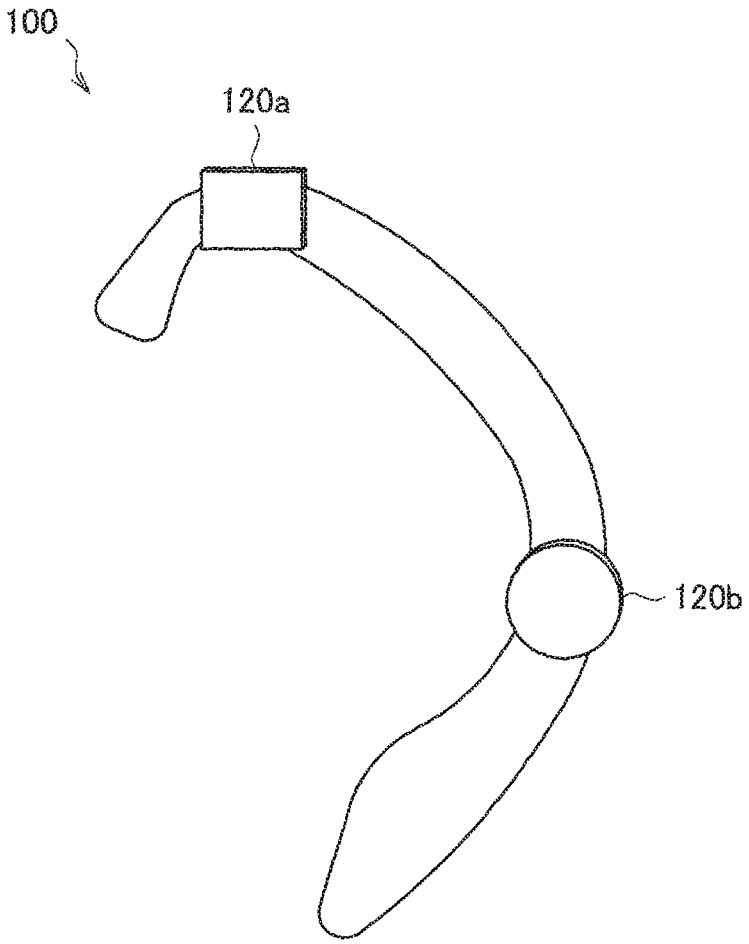
FIG. 14 is an explanatory diagram illustrating an appearance example of the audio playback device 100.

FIG. 14 is an explanatory diagram illustrating an example of appearance of the audio playback device 100 according to an embodiment of the present disclosure. FIG. 14 illustrates an example of appearance of the audio playback device 100 according to an embodiment of the present disclosure in a form of an ear-hook type when a listener is caused to listen to stereo sounds by a bone conduction sound.

In the audio playback device 100 illustrated in FIG. 14, the vibration applying unit 120*a* is provided so as to be worn in the area 1 in FIG. 1. Further, the vibration applying unit 120*b* is provided on the same side (in the example in FIG. 14, the right side of the head area of a listener) as the side on which the vibration applying unit 120*a* is provided, so as to be worn in the area 12 in FIG. 2.

The vibration applying units 120*a* and 120*b* are provided as illustrated in FIG. 14 and bone conduction sounds are presented from the vibration applying units 120*a* and 120*b*, respectively, and thus the audio playback device 100 according to an embodiment of the present disclosure can allow a listener to detect as if sounds are not emitted on one side of the head area but stereo sounds are emitted.

Figure 15A:
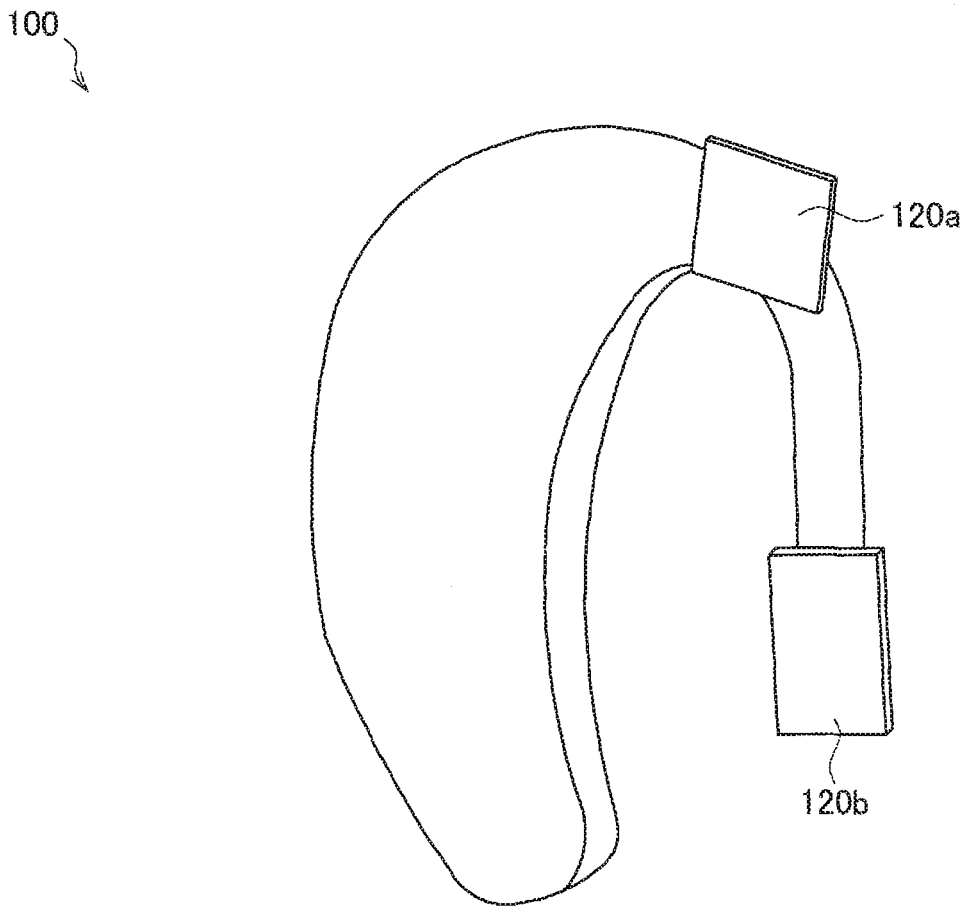
FIG. 15A is an explanatory diagram illustrating an appearance example of the audio playback device 100.
Figure 15B:
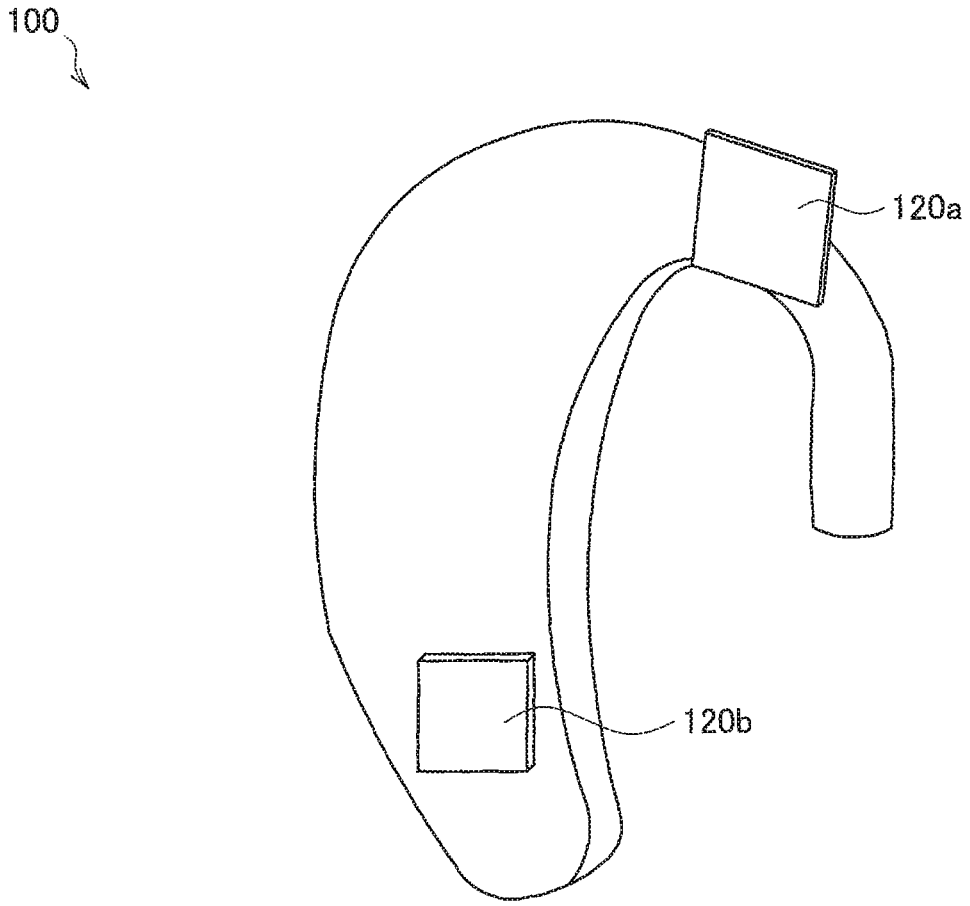
FIG. 15B is an explanatory diagram illustrating an appearance example of the audio playback device 100.

Another example of appearance of the audio playback device 100 will be shown. FIG. 15A is an explanatory diagram illustrating an example of appearance of the audio playback device 100 according to an embodiment of the present disclosure. FIGS. 15A and 15B illustrate an example of appearance of the audio playback device 100 according to an embodiment of the present disclosure in a form of an ear-hook type when a listener is caused to listen to stereo sounds by a bone conduction sound. Further, FIGS. 15A and 15B illustrate an example of appearance of the audio playback device 100 when a sound signal is received wirelessly from another device (for example, a music playback device or a mobile phone such as a smartphone).

In the audio playback device 100 illustrated in FIG. 15A, the vibration applying unit 120*a* is provided so as to be worn in the area 1 in FIG. 1. Further, the vibration applying unit 120*b* is provided on the same side (in the example in FIG. 15A, the left side of the head area of a listener) as the side on which the vibration applying unit 120*a* is provided, so as to be worn in the area 11 in FIG. 2.

The vibration applying units 120*a* and 120*b* are provided as illustrated in FIG. 15A and bone conduction sounds are presented from the vibration applying units 120*a* and 120*b*, respectively, and thus the audio playback device 100 according to an embodiment of the present disclosure can allow a listener to detect as if sounds are not emitted on one side of the head area but stereo sounds are emitted.

Meanwhile, in the audio playback device 100 that receives a sound signal wirelessly from another device, the vibration applying unit 120*b* that presents a bone conduction sound may be provided at a position as illustrated in FIG. 15B.

Figure 16:
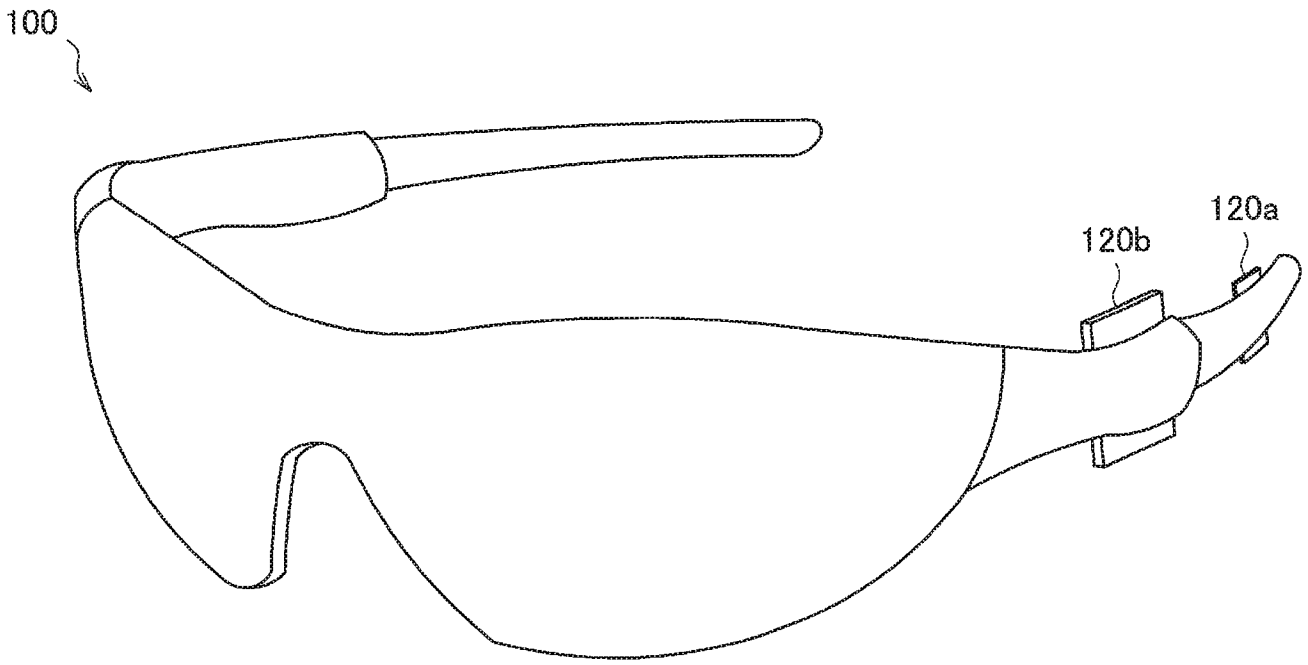
FIG. 16 is an explanatory diagram illustrating an appearance example of the audio playback device 100.

Another example of appearance of the audio playback device 100 will be shown. FIG. 16 is an explanatory diagram illustrating an example of appearance of the audio playback device 100 according to an embodiment of the present disclosure. FIG. 16 illustrates an example of appearance of the audio playback device 100 according to an embodiment of the present disclosure in a form of a sunglass type when a listener is caused to listen to stereo sounds by a bone conduction sound.

In the audio playback device 100 illustrated in FIG. 16, the vibration applying unit 120*a* is provided so as to be worn in the area 1 in FIG. 1. Further, the vibration applying unit 120*b* is provided on the same side (in the example in FIG. 14, the left side of the head area of a listener) as the side on which the vibration applying unit 120*a* is provided, so as to be worn in the area 11 in FIG. 2.

The vibration applying units 120*a* and 120*b* are provided as illustrated in FIG. 16 and bone conduction sounds are presented from the vibration applying units 120*a* and 120*b*, respectively, and thus the audio playback device 100 according to an embodiment of the present disclosure can allow a listener to detect as if sounds are not emitted on one side of the head area but stereo sounds are emitted.

Figure 17:
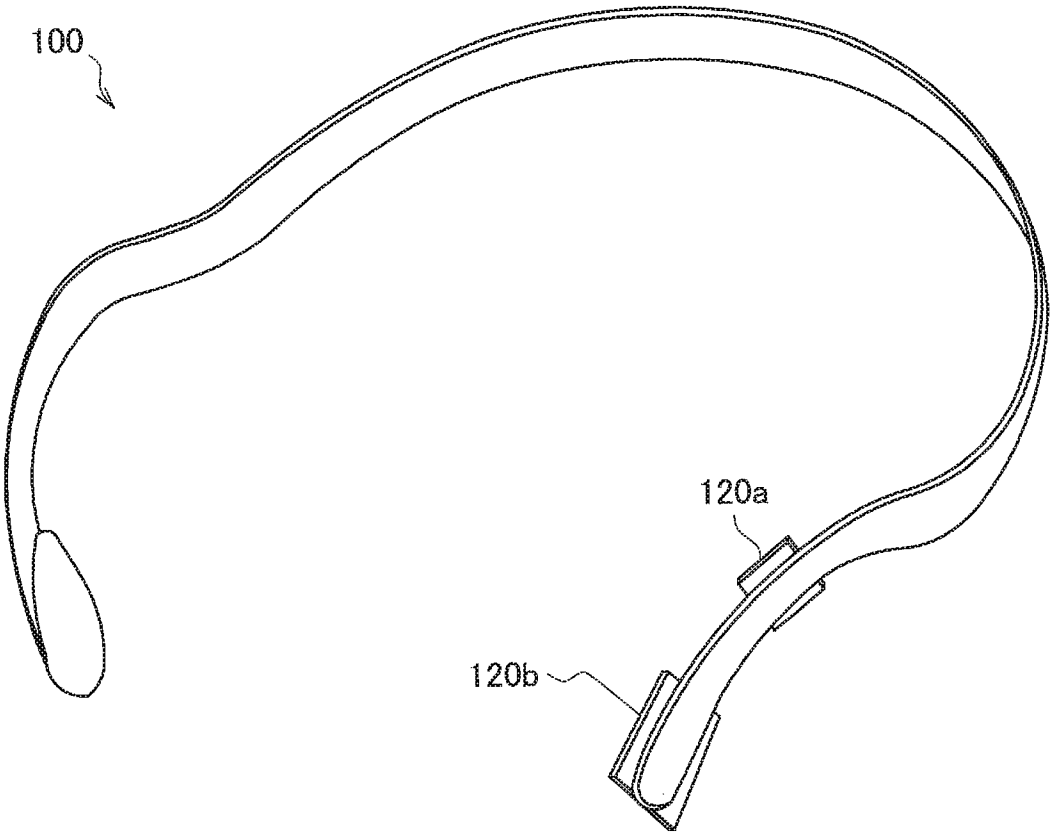
FIG. 17 is an explanatory diagram illustrating an appearance example of the audio playback device 100.

Another example of appearance of the audio playback device 100 will be shown. FIG. 17 is an explanatory diagram illustrating an example of appearance of the audio playback device 100 according to an embodiment of the present disclosure. FIG. 17 illustrates an example of appearance of the audio playback device 100 according to an embodiment of the present disclosure in a form of a neckband type when a listener is caused to listen to stereo sounds by a bone conduction sound.

In the audio playback device 100 illustrated in FIG. 17, the vibration applying unit 120*a* is provided so as to be worn in the area 1 in FIG. 1. Further, the vibration applying unit 120*b* is provided on the same side (in the example in FIG. 14, the left side of the head area of a listener) as the side on which the vibration applying unit 120*a* is provided, so as to be worn in the area 11 in FIG. 2.

The vibration applying units 120*a* and 120*b* are provided as illustrated in FIG. 17 and bone conduction sounds are presented from the vibration applying units 120*a* and 120*b*, respectively, and thus the audio playback device 100 according to an embodiment of the present disclosure can allow a listener to detect as if sounds are not emitted on one side of the head area but stereo sounds are emitted.

Meanwhile, in the above-described audio playback device 100, audio signals may be input in a wired or wireless manner. When audio signals are input wirelessly, needless to say, the audio playback device 100 includes a receiver that receives audio signals wirelessly, a battery for operation, and a charger for charging the battery. For example, in the audio playback device 100 illustrated in FIG. 15A and FIG. 15B, the receiver, the battery and the charger may be provided in an area on the left side of the audio playback device 100 in the respective drawings. Further, by presenting a bone conduction sound to a listener by the vibration applying units 120*a* and 120*b*, the audio playback device 100 illustrated in FIG. 15A and FIG. 15B can allow a listener to detect as if stereo sounds are emitted even in a case that audio signals are input wirelessly.

Further, when the audio playback device 100 is configured as illustrated in FIG. 16 and FIG. 17, the receiver, the battery and the charger may be provided on the side where the vibration applying units 120*a* and 120*b* are not provided. The receiver, the battery and the charger are provided on the side where the vibration applying units 120*a* and 120*b* are not provided, and thus it is possible for the audio playback device 100 illustrated in FIG. 16 and FIG. 17 to allow a listener to detect as if stereo sounds are emitted, while improving a space efficiency.

Audio signals input to the audio playback device 100 may include more than two channels. For example, when surround audio signals of 5.1 channels are supplied to the audio playback device 100, 2-channelization utilizing such a technology as virtual headphone technology (VPT) processing or downmix processing may be performed in the input signal processor 112.

Moreover, in a case that a listener is caused to listen to bone conduction sounds by two vibration applying units, when 2-channel audio signals are input as an input, the input signal processor 112 may perform processing that determines which signal is to be the sound output from the vibration applying unit 120*a*. The input signal processor 112 determines that a sound based on which audio signal is to be output from the vibration applying unit 120*a*, and thus it becomes possible to allow a listener to listen to stereo sounds even when the listener wears the audio playback device 100 on either left or right ear.

Further, the above-described function of the signal processor 110 may be provided for a digital signal processor (DSP) etc. of devices connected to the audio playback device 100 (for example, devices such as a smartphone and a portable audio player).

Meanwhile, the size and figure of the vibration applying unit in respective examples of appearance are not limited to the size shown in the respective drawings. The size and figure of the vibration applying unit do not matter if the size and figure allow a listener to feel favorably sounds at a wearing position or positions apart from the wearing position and are in a practical range.

[1.4. Modified Examples]

In the above embodiments, there is shown the audio playback device 100 that presents a bone conduction sound to a listener with one or two vibration applying units. The number of vibration applying units may be three or more. When three or more vibration applying units are to be provided, they may be assigned so that, for example, the sound is presented to each of 2-channel sounds from at least one vibration applying unit.

For example, in addition to the vibration applying units 120*a* and 120*b* in the audio playback device 100 illustrated in FIG. 15A, the vibration applying unit 120*b* illustrated in FIG. 15B is provided. Consequently, two vibration applying units 120*b* are worn so as to be located at positions of the area 11 and the area 12 of a listener illustrated in FIG. 2, and the audio playback device 100 in which the number of vibration applying units is made three can be realized. That is, the audio playback device 100, which may allow a listener to feel sounds respectively on the side on which two vibration applying units 120*b* are worn and on the opposite side thereof, can be realized on the side on which the vibration applying unit 120*a* is worn.

As described above, the audio playback device 100 is used which presents a bone conduction sound to a listener with a vibration applying unit provided at a position at which a sound is heard as if a bone conduction sound is emitted at a place apart from a wearing position, and thus it becomes possible to allow a listener to listen to sounds from various directions. By utilizing such an inherent perception owned by the bone conduction (a kind of cross perception), it is possible for the audio playback device 100 to allow a listener to distinguish favorably a bone conduction sound via the vibration applying unit from ordinary sounds via air conduction or bone conduction. Meanwhile, "cross perception" means perception of perceiving sounds on the opposite side of the position to which a bone conduction device is attached.

For example, let's consider a case of causing a listener to listen to contents of a movie etc. with sub voice such as narration or comments of the contents. In this case, the vibration applying unit is provided that allows a listener to listen to the sub voice via a bone conduction sound in addition to a driver allowing the listener to listen to sounds of the contents from left and right ears via an air conduction sound, and thus the audio playback device 100 can allow the listener to distinguish favorably the bone conduction sound from the air conduction sound.

Such an audio playback device 100 makes it possible, for example when a listener is caused to view a movie of a foreign language, to allow the listener to listen to favorably and simultaneously surrounding circumstances via a bone conduction sound, in addition to subtitles displayed on the screen. With conventional subtitles alone, the number of characters of subtitles is made small intentionally because the tracing speed of a listener with eyes is limited, but the audio playback device 100 as described above can give a remarkably large number of pieces of additional information to a listener as compared with a case of subtitles alone, by allowing the listener to favorably and simultaneously listen to also surrounding circumstances via a bone conduction sound.

Figure 18:
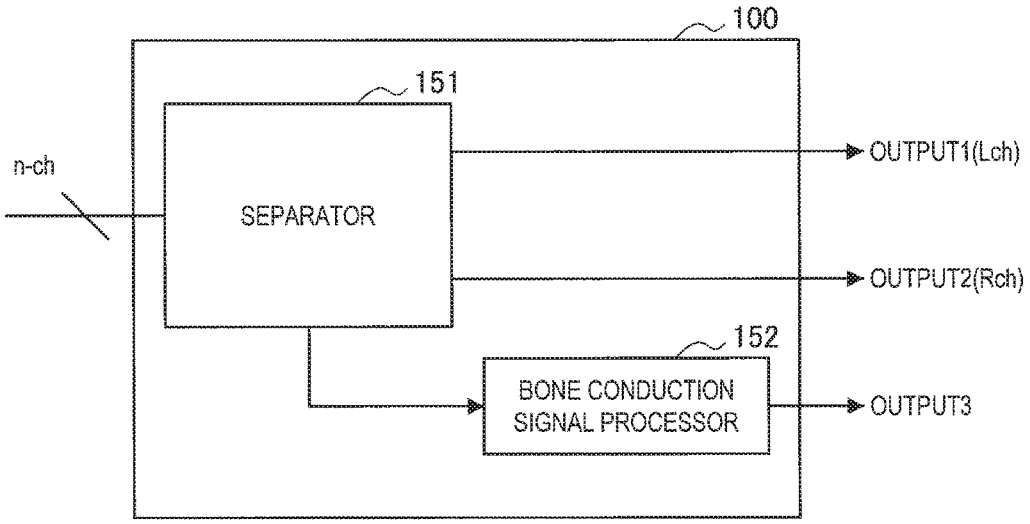
FIG. 18 is an explanatory diagram illustrating an example of a functional configuration of an audio playback device 100.

FIG. 18 is an explanatory diagram illustrating an example of functional configuration of the audio playback device 100 according to an embodiment of the present disclosure. As illustrated in FIG. 18, the audio playback device 100 includes a separator 151 and a bone conduction signal processor 152. To the audio playback device 100 illustrated in FIG. 18, main information including an audio signal of at least two channels and sub-information including a signal of one channel (info) are supplied. Meanwhile, in the present embodiment, the main information means information to be mainly listened to by a listener, and the sub-information means secondary information different from the main information.

The separator 151 separates a signal supplied to the audio playback device 100 into main information and sub-information. As to the separated information, the main information is output, for example, as an air conduction sound, and the sub-information is output to the bone conduction signal processor 152. In FIG. 18, the main information is output as two outputs (output 1, output 2). In FIG. 18, it is so illustrated that the output 1 is an output for the left ear (L channel), and the output 2 is an output for the right ear (R channel), but, of course, it is not limited to the example. Meanwhile, the main information may be output as a bone conduction sound instead of an air conduction sound. When the main information is output as a bone conduction sound, signal processing is performed if necessary.

The bone conduction signal processor 152 performs prescribed signal processing adjusted for a vibration applying unit that outputs the sub-information as a bone conduction sound. The signal processing performed by the bone conduction signal processor 152 may include, for example, such processing as adjustment of a frequency component, or amplification or phase adjustment of a signal. The adjustment processing of a frequency component performed by the bone conduction signal processor 152 may include such processing as lowering a high register, amplifying a mid-range or amplifying a low register. In FIG. 18, the sub-information is output as an output (output 3).

A vibration applying unit that outputs a bone conduction sound on the basis of the signal output from the bone conduction signal processor 152 is worn at a prescribed position of the head area of a listener. The prescribed position is a position different from output positions of the outputs 1 and 2.

With the configuration as that in FIG. 18, the audio playback device 100 can allow a listener to distinguish favorably sub-information by a bone conduction sound from main information when the listener is caused to listen to a mixed sound of the main information and the sub-information. In the example illustrated in FIG. 18, for example, if narration is added as sub-information when a listener listens to 2-channel stereo sounds, it is possible to allow the listener to listen to the narration by a bone conduction sound.

Meanwhile, when an input has only two channels, that is, a source contains sub-information in a 2-channel input, the separator 151 may extract the sub-information part from the 2-channel source and output the extracted sub-information to the bone conduction signal processor 152. Upon extracting the sub-information part from the 2-channel source, the separator 151 may pick out a sub-information part to be input in monaural from two channels.

Further, when an input has only two channels and speech or vocal of music is to be listened to as sub-information, the separator 151 may extract a common component from the 2-channel source as sub-information, and output the extracted sub-information to the bone conduction signal processor 152.

Furthermore, when an input has 3 or more channels and a center channel (C) exists in the input, the separator 151 may output the center channel as an output 3.

Moreover, an input may have 3 or more channels, for example, 3 channels, 5 channels, or 7 channels. In this case, the audio playback device 100 performs processing of converting the multichannel to two channels, and performs processing of outputting sub-information as a bone conduction sound.

Figure 19:
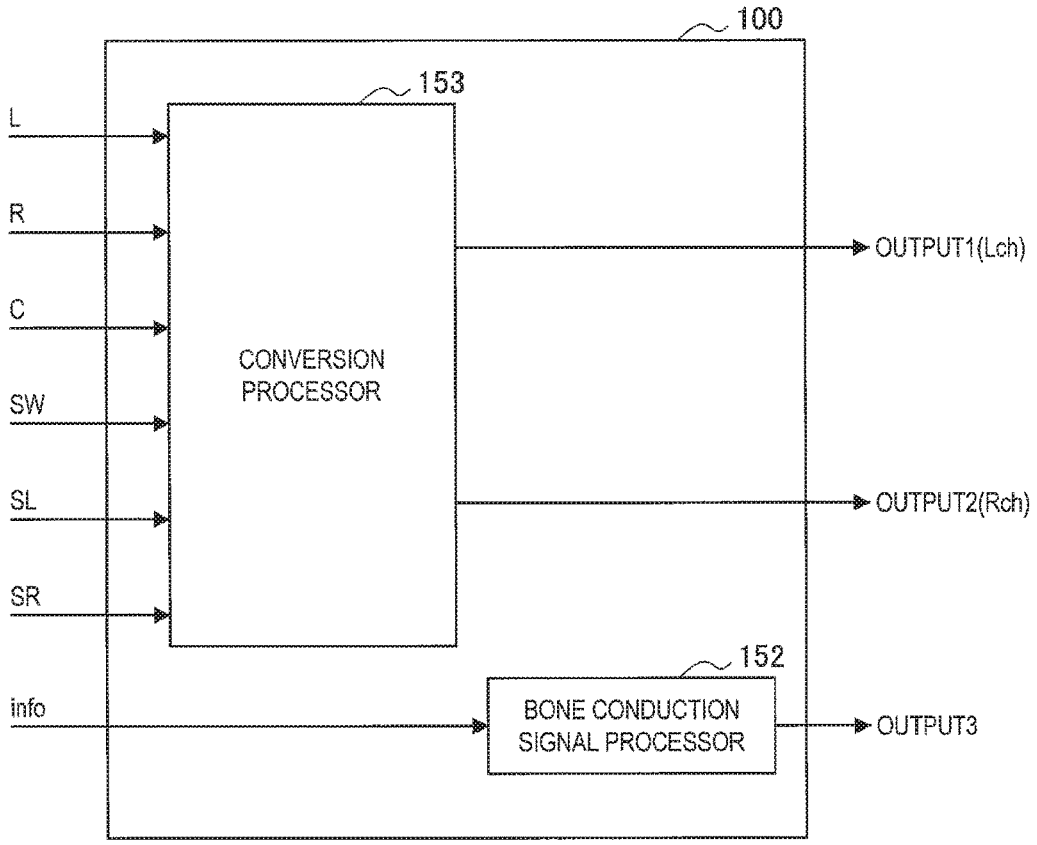
FIG. 19 is an explanatory diagram illustrating an example of a functional configuration of an audio playback device 100.

FIG. 19 is an explanatory diagram illustrating an example of functional configuration of the audio playback device 100 according to an embodiment of the present disclosure. As illustrated in FIG. 19, the audio playback device 100 includes a conversion processor 153 and the bone conduction signal processor 152. To the audio playback device 100 illustrated in FIG. 19, main information including 6-channel (L, R, C, SW, SR, SL) audio signals and sub-information including a 1-channel signal (info) are supplied.

The conversion processor 153 performs processing of converting the 6-channel (L, R, C, SW, SR, SL) audio signals to 2-channel audio signals. The conversion processor 153 performs such processing as downmix processing or VPT processing as processing of converting the 6-channel audio signals to 2-channel audio signals. When an input has 3 or more channels as described above, too, the audio playback device 100, with the configuration illustrated in FIG. 19, can allow a listener to distinguish favorably sub-information by a bone conduction sound when causing the listener to listen to a sound in which main information and sub-information are mixed.

Meanwhile, a place to which the vibration applying unit of the audio playback device 100 is attached in the head area of a listener may be a position for causing a sound to be heard on the opposite side of the attached place, or, more favorably, a position for causing a sound to be heard, for example, near the center in the head, apart from the position to which the vibration applying unit is attached. As to the adjustment of an audible position, a listener may perform fine adjustment so as to attach the vibration applying unit to an effective region, or a listener may perform adjustment by changing attaching strength of the vibration applying unit.

By outputting a sound via air conduction that causes such main information as music or movie to be listened to and a bone conduction sound by the vibration applying unit that causes sub-information such as narration or comments to be listened to in this way, the audio playback device 100 can allow a listener to favorably listen to concurrently the sub-information while listening to the main information. On this occasion, the audio playback device 100 can prevent mixing with the main information, by adjusting suitably the listening position of the sub-information.

Meanwhile, sub-information that the audio playback device 100 outputs is not limited to information associated with contents being main information. The audio playback device 100 may output such a sound as prompting a listener to awake attention, as the sub-information.

In the above description, there is shown an example of allowing a listener to listen to stereo sounds by an air conduction sound, and, by applying this, the audio playback device 100 makes it possible to allow a listener to distinguish sub-information from main information using the vibration applying unit alone. For example, the audio playback device 100 causes main information (or sub-information) to be listened to from a vibration applying unit that presents a sound in the wearing position, and causes sub-information (or main information) to be listened to from a vibration applying unit that presents a sound in a place apart from the wearing position. By allowing a listener to listen to the main information and sub-information by bone conduction sounds in this way, the audio playback device 100 can allow the listener to distinguish favorably the sub-information from the main information.

The present embodiment can also be applied to the audio playback device 100 in FIG. 8 to FIG. 12. That is, when description is given quoting FIG. 7, out of input signals in FIG. 7, sub-information is output to the bone conduction signal generator 114, and, out of input signals, prescribed main information is output to the air conduction signal generator 115. Further, the main information is caused to be listened to with the speaker unit 130 illustrated in FIG. 7, and the sub-information is caused to be listened to with the vibration applying unit 120.

For example, the prescribed main information may be information obtained by making stereo signals into a monaural signal, or information obtained by synthesizing all multi-channels, or information obtained by selecting any channel. Further, prescribed signal processing for allowing a listener to listen favorably may be added to the prescribed main information.

In the playback of a 2-channel sound via air conduction or bone conduction, favorable distinguishing can be realized by making a sound of multichannel such as 5 channels or 7 channels into two channels by a head-related transfer function (HRTF) coefficient etc., for example, using a VPT technology. On this occasion, it is more effective when the audio playback device 100 does not allow the added sub-information to be localized at the central portion (center) of a listener. Because, a sound is arranged at the center in most of main information in an output made into two channels, and, if sub-information is also arranged at the center, occasionally the main information and the sub-information are heard by a listener in a mixed condition.

Concretely, when main information has two channels of an L channel and R channel and sub-information to be added has one channel, the audio playback device 100 adds the sub-information to be added to the main information at a ratio other than 50%:50% in a right-and-left ratio. Hereby, when the original sound information being the main information is music or movie, since vocal is usually arranged at the center, the sub-information is offered with the localization position changed from the vocal. Accordingly, when a listener listens to a sound played back with the audio playback device 100, separation of the sub-information from the main information becomes easy. Meanwhile, when sub-information to be added has 2 or more channels, the audio playback device 100 allocates the sub-information to be added to an L channel or an R channel.

Figure 20:
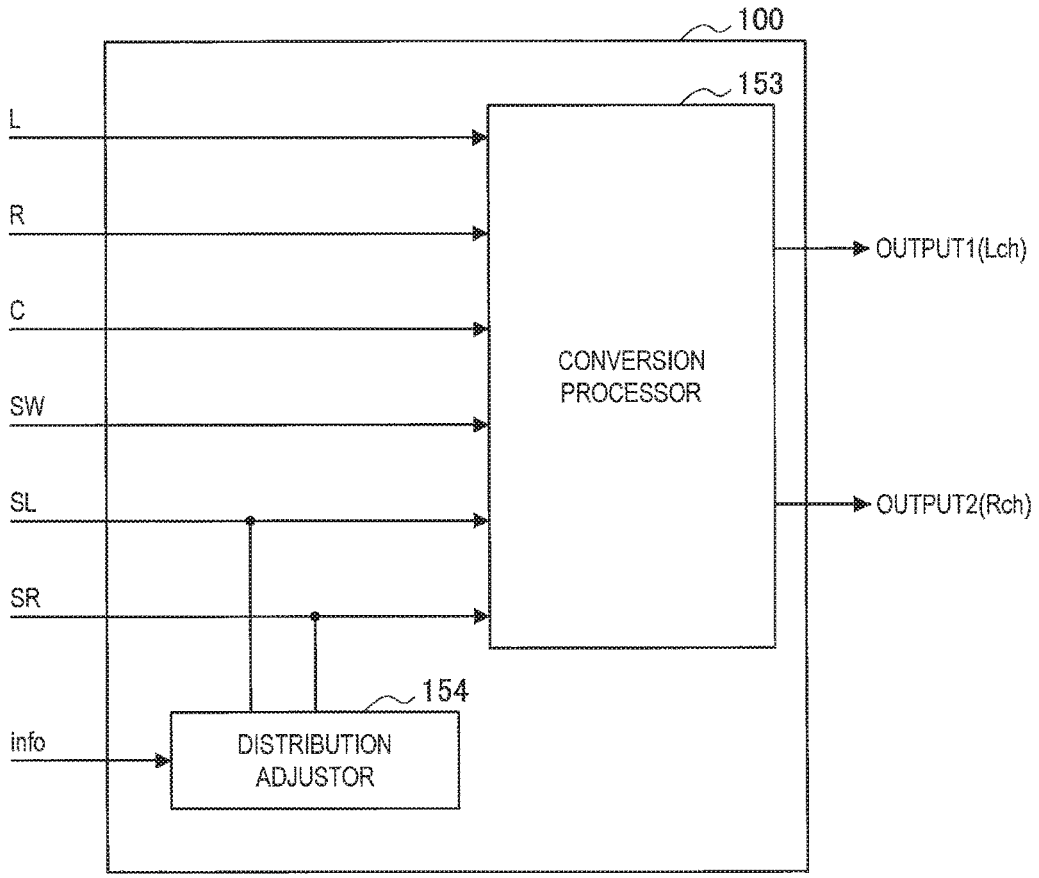
FIG. 20 is an explanatory diagram illustrating an example of a functional configuration of an audio playback device 100.

FIG. 20 is an explanatory diagram illustrating an example of functional configuration of the audio playback device 100 according to an embodiment of the present disclosure. As illustrated in FIG. 20, the audio playback device 100 includes the conversion processor 153 and a distribution processor 154. To the audio playback device 100 illustrated in FIG. 20, main information including audio signals of 6 channels (L, R, C, SW, SR, SL) and sub-information including a signal of 1 channel (info) are supplied.

The distribution processor 154 performs processing of distributing the sub-information including a signal of 1 channel at a ratio other than 50:50 in a right-and-left ratio. In the example illustrated in FIG. 20, the distribution processor 154 distributes the sub-information to an SR channel and an SL channel at a ratio other than 50:50 in a right-and-left ratio. Meanwhile, desirably distribution destinations of the sub-information by the distribution processor 154 are channels other than the L channel, R channel and C channel. For example, when main information to be input contains an audio signal of front high, a channel of front high may be selected as the distribution destination of the sub-information by the distribution processor 154.

The conversion processor 153 performs processing of converting audio signals of 6 channels (L, R, C, SW, SR, SL) to audio signals of 2 channels. As the processing of converting audio signals of 6 channels into audio signals of 2 channels, the conversion processor 153 performs such processing as downmix processing or VPT processing. In the example illustrated in FIG. 20, a listener is caused to listen to the 2-channel audio signals output by the conversion processor 153 as an air conduction sound or a bone conduction sound.

The audio playback device 100, with the configuration illustrated in FIG. 20, can localize sub-information in a place other than the central portion (center) of a listener and allow the listener to favorably listen to the sub-information.

As a configuration that gives the above effect more simply, the output from a distribution adjuster 154 in FIG. 20 may be output to only either SL or SR. Further, the output from the distribution adjuster 154 is output to only either SL or SR and the gain of the output may be adjusted. When the output from the distribution adjuster 154 is to be output to only either SL or SR, for example, even if the output from the distribution adjuster 154 is output to only SL by the VPT technology, a listener can listen to sub-information not only on the L channel but also on the R channel. As the result, by localizing the sub-information in a place other than the central part (center) of a listener, it is possible to allow the listener to favorably listen to the sub-information.

Figure 21:
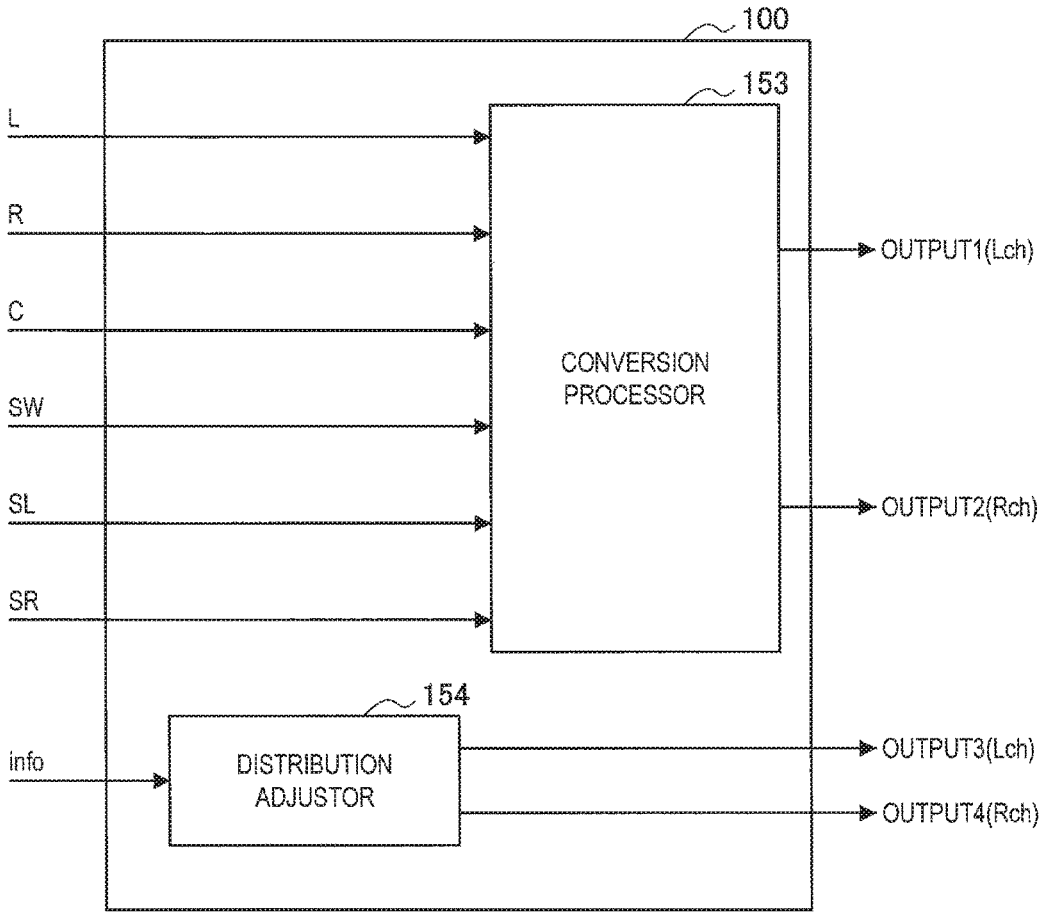
FIG. 21 is an explanatory diagram illustrating an example of a functional configuration of an audio playback device 100.

Here, of course sub-information may be listened to by a bone conduction sound. FIG. 21 is an explanatory diagram illustrating an example of functional configuration of the audio playback device 100 according to an embodiment of the present disclosure. As illustrated in FIG. 21, the audio playback device 100 includes the conversion processor 153 and the distribution processor 154. To the audio playback device 100 illustrated in FIG. 21, main information including audio signals of 6 channels (L, R, C, SW, SR, SL) and sub-information including a signal of 1 channel (info) are supplied.

The configuration example of the audio playback device 100 illustrated in FIG. 21 is a configuration when the sub-information is caused to be listened to as a bone conduction sound by a listener. The distribution processor 154 performs processing for distributing the sub-information including a 1-channel signal at a ratio other than 50:50 in a right-and-left ratio and outputting the sub-information to a vibration applying unit so as to be listened to as a bone conduction sound by a listener.

If sub-information to be added is deviated to only one side when the audio playback device 100 causes a sound to be listened to for a long time, it is considered that long trial listening is a burden on a listener to cause the listener to get tired of listening. Therefore, in the audio playback device 100, the sub-information may be output from the left side or the right side on the basis of a prescribed rule, in addition to be added at a ratio other than 50:50 in a right-and-left ratio as described above. The rule may be, for example, a rule that the channel outputting the sub-information is switched to either left or right after a certain time, or, in a case that the sub-information includes narration and the narration includes a male voice and a female voice, a rule that the sub-information is distributed to either left or right on the basis of the sex of the voice.

Further, when contents are a movie, a drama etc., the rule may be a rule that the channel outputting the sub-information is switched in conjunction with switching of scenes of the movie or the drama. The audio playback device 100 may use information previously accompanied to contents for switching a scene, or may detect the switching of scene by sound analysis of contents. Meanwhile, upon switching a channel that outputs sub-information, the audio playback device 100 does not perform switching at a stage that causes a user to feel unpleasant such as switching in the middle of narration.

The audio playback device 100 can allow a listener to distinguish comfortably sub-information and enjoy main information, even in a case of causing the listener to listen for a long time, by switching the output of sub-information in this way.

Here, when the output 3 and the output 4 in FIG. 21 are caused to be listened to by a bone conduction sound, the vibration applying unit of the audio playback device 100 illustrated in FIG. 14 to FIG. 17 may be used. Further, to the output 1 and the output 2 in FIG. 21, a headphone including a speaker unit for causing an air conduction sound to be listened to may be added. Of course, all these vibration applying unit and speaker unit may be configured with one headphone, or the vibration applying unit and the speaker unit may be configured with separate headphones.

In a case that main information has sound information also in rear such as 5.1 channels and, in addition, sub-information is given to a channel to which main information out of the main information is not output, such as a rear channel, when the main information overlaps the sub-information in the same channel, for example, the audio playback device 100 detects difference in the level between the main information and the sub-information and the gain of the main information is reduced or the gain of the sub-information is increased so that the difference becomes a prescribed value or more.

In a case of a multichannel sound such as a 5.1-channel sound, in the rear channel, frequently a sound other than a phonetic sound such as environmental sound continues. Accordingly, the audio playback device 100 can allow a listener to comfortably listen to sub-information and allow the listener to enjoy main information, for example, by detecting the difference between the levels of the main information and the sub-information and reducing the gain of the main information or increasing the gain of the sub-information so that the difference becomes a prescribed value or more.

A suitable practical example of the audio playback device 100 will be shown. For example, when a 5.1-channel or 7.1-channel surround sound is converted into a 2-channel sound by use of VPT and caused to be listened to by a listener, the audio playback device 100 localizes, for example, sounds of a movie in front and audio guide on the right or left in rear. That is, the listener can receive a follow by an audio guide even when being immersed in the movie. This is very effective, for example, when a listener sees a movie in English.

Further, when such a case is taken into account that a listener hears an audio guide for a long time, it is more effective to output the audio guide with switching from left (right) to right (left) by the audio playback device 100, rather than outputting the audio guide from the same place at all times.

The audio playback device 100 can also localize, for example, music in front and a sound linked to navigation on the right or left of the rear. That is, a listener can obtain new information with almost no feeling of troublesome even when a sound linked to navigation interrupts enjoying music. That is, since the sound linked to the navigation is heard not mixed with but separated from the music, the listener can effectively distinguish the sound linked to navigation output from the audio playback device 100.

There are differences among individuals in distinguishing sounds on the basis of HRTF. In contrast, by causing a listener to listen to main information and sub-information by a bone conduction sound, the audio playback device 100 can allow the listener to suitably distinguish the sub-information from the main information without depending on differences among individuals.

The audio playback device 100 may alter a sound quality (add such processing as altering a sound quality on the basis of a codec, or attenuating a high register), or may set the localization position of sub-information to a position to be heard about ears instead of the center of right-and-left, for causing a listener to distinguish more favorably the sub-information. The alteration in the sound quality or the alteration in the localization position may be performed, for example, with the conversion processor 153. The audio playback device 100 can allow a listener to distinguish more favorably the sub-information by altering the sound quality of the sub-information and then performing surround processing on main information, rather than performing simple downmix on main information.

The audio playback device 100 can allow a listener to favorably distinguish sub-information because different feeling such as a bone conduction sound is given to the listener with respect to such a factor including differences among individuals as a sound by HRTF, by altering a sound quality of the sub-information (such as altering a sound quality by way of a codec, or attenuating a high register) or setting the localization position of the sub-information to a position to be heard about ears instead of the center of right-and-left.

For example, in a case that a listener hears separately narration wearing the audio playback device 100 configured as an open type headphone that allows an auricle to be open upon previewing at full blast in a theater etc., the audio playback device 100 applies adaptive differential pulse code modulation (ADPCM) to the narration. ADPCM system lowers a sound quality at the sampling frequency of 8 kHz. It was confirmed by the research of the inventor that a listener could favorably hear narration even in large volume by applying ADPCM to the narration with the audio playback device 100.

Figure 22:
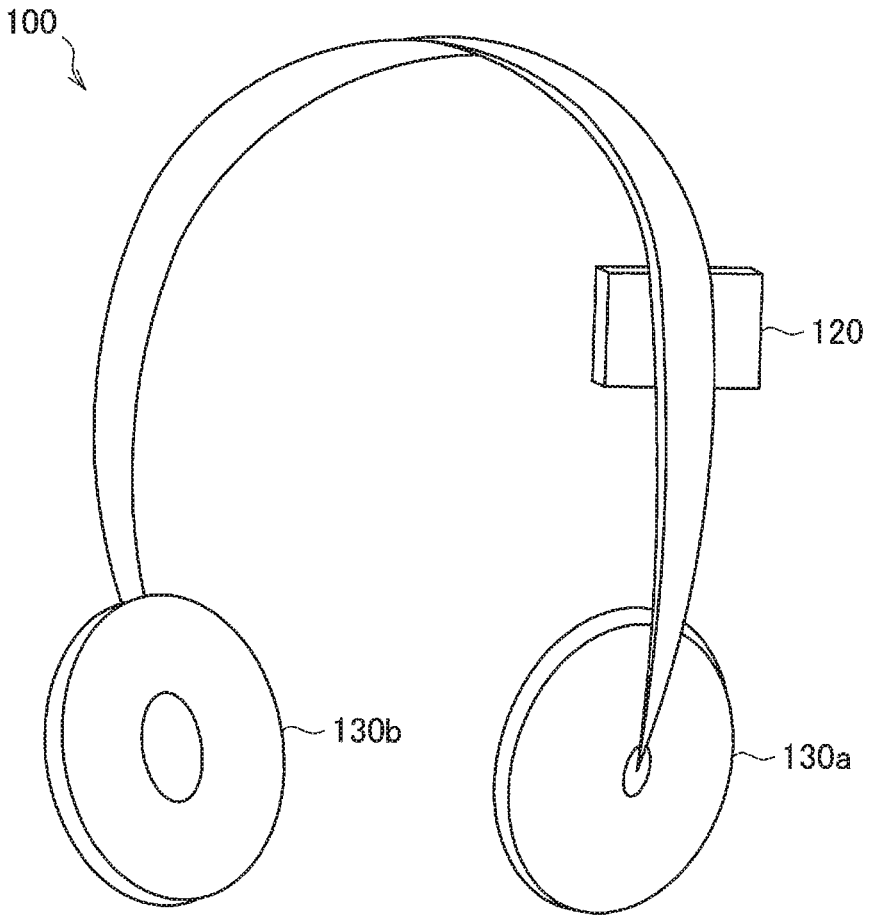
FIG. 22 is an explanatory diagram illustrating an appearance example of the audio playback device 100.

An example of appearance of the audio playback device 100 suitable for distinguishing sub-information by a bone conduction sound will be described. FIG. 22 is an explanatory diagram illustrating an example of appearance of the audio playback device 100.

The audio playback device 100 illustrated in FIG. 22 includes the vibration applying unit 120 that outputs a bone conduction sound, and speaker units 130*a* and 130*b* that output an air conduction sound. The vibration applying unit 120 is provided at a position that localizes a sound image in a place apart from a worn position, when the audio playback device 100 is worn on a listener. The audio playback device 100 illustrated in FIG. 22 is an example for realizing the audio playback device 100 having an example of functional configuration, for example, illustrated in FIG. 18 and FIG. 19.

The vibration applying unit 120 is provided so as to be worn in the area 1 in FIG. 1. The vibration applying unit 120 is provided so as to be worn in the area 1 in FIG. 1 and presents sub-information, and thus the audio playback device 100 according to an embodiment of the present disclosure can allow a listener to detect as if the sound is not emitted around the area 1 but is emitted in a different place from the area 1, for example, at the central portion in the head.

The audio playback device 100, with the configuration as illustrated in FIG. 22, can allow a listener to effectively distinguish sub-information by a bone conduction sound. Of course, the configuration of the audio playback device 100 is not limited to the configuration as illustrated in FIG. 22. The audio playback device 100 may be provided with a vibration applying unit at least at a position that localizes a sound image in a place apart from a worn position, in order to allow a listener to distinguish the sub-information by a bone conduction sound.

<2. Summary>

As described above, according to an embodiment of the present disclosure, the audio playback device 100, in which at least one vibration applying unit is worn only on one side of the head area of a listener, is provided.

In the audio playback device 100 according to an embodiment of the present disclosure, a vibration applying unit that presents a bone conduction sound is provided so as to be located at a position that does not cause a bone conduction sound to be heard as if emitted in a place near a wearing position but causes a bone conduction sound to be heard as if emitted in a place apart from the wearing position. With the audio playback device 100 according to an embodiment of the present disclosure, the vibration applying unit is provided in such a position, and thus it is possible to allow a listener to listen to sounds from various directions, even when the vibration portion of a bone conduction speaker is provided only on one side of the head.

Further, with the audio playback device 100 according to an embodiment of the present disclosure, the vibration applying unit is provided so as to be located at a position that causes a bone conduction sound to be heard as if emitted in a place apart from a wearing position, and additionally a speaker unit that presents an air conduction sound or a vibration applying unit that presents a bone conduction sound is provided. The vibration applying unit and the speaker unit are provided in this way, and thus the audio playback device 100 according to an embodiment of the present disclosure makes it possible to allow a listener to listen to sounds so as to feel an expanse in sound, even when a device representing a bone conduction sound or an air conduction sound is worn only on one side of the head area of the listener.

Further, a computer program can be created which causes hardware such as a CPU, ROM, or RAM, incorporated in each of the devices, to function in a manner similar to that of structures in the above-described devices. Furthermore, it is possible to provide a recording medium having the computer program recorded thereon. Moreover, by configuring respective functional blocks shown in a functional block diagram as hardware, the hardware can achieve a series of processes.

The preferred embodiment(s) of the present disclosure has/have been described above with reference to the accompanying drawings, whilst the present disclosure is not limited to the above examples. A person skilled in the art may find various alteratios and modifications within the scope of the appended claims, and it should be understood that they will naturally come under the technical scope of the present disclosure.

Further, the effects described in this specification are merely illustrative or exemplified effects, and are not limitative. That is, with or in the place of the above effects, the technology according to the present disclosure may achieve other effects that are clear to those skilled in the art on the basis of the description of this specification.

Additionally, the present technology may also be configured as below.

(1)

An audio playback device including:

at least one bone conduction device, wherein the bone conduction device is provided at a position to be worn at a prescribed position of a head area of a listener, and the prescribed position is a position allowing the listener to feel that a sound source moves from a position to which the bone conduction device is attached and to feel the sound source from another position.

(2)

The audio playback device according to (1), wherein the audio playback device outputs sounds of at least two channels, the bone conduction device is used for output of at least one channel out of the sounds of two channels, and the device outputting the sounds of two channels is provided at a position to be worn in either region on a right side or a left side of the head area of the listener.

(3)

The audio playback device according to (2), including:

an air conduction device configured to output the other channel out of the sounds of two channels.

(4)

The audio playback device according to (1), wherein the audio playback device outputs sounds of at least two channels, the bone conduction device is used for output of a channel located farther from a wearing position out of the sounds of two channels, and a device outputting the sounds of two channels is provided at a position to be worn in either region on a right side or a left side of the head area of the listener.

(5)

The audio playback device according to (4), including:

an air conduction device configured to output the other channel out of the sounds of two channels.

(6)

The audio playback device according to (5), further including:

a bone conduction signal generator configured to perform signal processing on a sound output from the bone conduction device to harmonize the sound with a sound output from the air conduction device.

(7)

The audio playback device according to (4), including:

a bone conduction device configured to output the other channel out of the sounds of two channels.

(8)

The audio playback device according to any of (4) to (8), wherein the bone conduction device configured to output a channel located father from a wearing position is provided at a position to be worn above an auricle of the listener.

(9)

The audio playback device according to any of (1) to (8), wherein the bone conduction device is provided at a position to be worn above an auricle of the listener.

(10)

The audio playback device according to any of (1) to (9), wherein the prescribed position is a position allowing the listener to feel that the sound source moves from a position to which the bone conduction device is attached and a sound image is localized in a head of the listener.

(11)

The audio playback device according to any of (1) to (9), wherein the prescribed position is a position allowing the listener to feel that the sound source moves from a position to which the bone conduction device is attached and a sound image is localized at a central portion in a head of the listener.

(12)

The audio playback device according to (1), wherein a sound output from the bone conduction device is sub-information that is secondary information different from main information causing the listener to listen to mainly.

(13)

The audio playback device according to (12), wherein a sound output from the bone conduction device as the sub-information is localized at a position different from a center of the head area of the listener.

(14)

The audio playback device according to (12) or (13), wherein the main information is output as a sound from an air conduction device or from a bone conduction device different from the bone conduction device.

(15)

The audio playback device according to (14), wherein the main information is output as sounds from two air conduction devices to be listened to via a pair of air conduction of the listener.

(16)

The audio playback device according to any of (12) to (15), wherein a sound output from the bone conduction device as the sub-information is localized on a right side or a left side of the head area of the listener.

(17)

The audio playback device according to (16), wherein a localization position of a sound output from the bone conduction device as the sub-information is changed on the basis of a prescribed rule.

(18)

The audio playback device according to (16) or (17), including:

a signal processor configured to change a quality of the sound output from the bone conduction device as the sub-information.

(19)

The audio playback device according to (18), further including:

a conversion processor configured to perform surround processing including a sound output as the main information after the signal processor changes the quality of the sound output from the bone conduction device as the sub-information.

REFERENCE SIGNS LIST

100 audio playback device
110 signal processor
112 input signal processor
114 bone conduction signal generator
115 air conduction signal generator
116 amplifier
117 amplifier
120 vibration applying unit
130 speaker unit
140 microphone
151 separator
152 bone conduction signal processor
153 conversion processor
154 distribution processor

The invention claimed is:

1. An audio playback device, comprising:

at least one bone conduction device; and an air conduction device, wherein a bone conduction device of the at least one bone conduction device is at a first position on the audio playback device, wherein the bone conduction device is wearable at a second position of a head area of a listener, wherein, based on the second position, the listener feels that a sound source moves from the first position to a third position different from the first position, wherein the audio playback device is configured to output sounds of at least two channels, wherein the bone conduction device is configured to:

receive a processed audio signal based on a 2-channel audio signal; and output sound of a first channel out of the sounds of the at least two channels, based on the received processed audio signal, and wherein the air conduction device is configured to output sound of a second channel out of the sounds of the at least two channels, based on the 2-channel audio signal.

2. The audio playback device according to claim 1, wherein the air conduction device and the bone conduction device are on one of a right side or a left side of the head area of the listener.

3. The audio playback device according to claim 1, wherein the second position of the bone conduction device is one of a first area, a second area, or a third area of the head area of the listener, wherein the first area comprises an area located around a side head area and above an ear of the listener, and an area located around the side head area and closer to a parietal region above an auricle of the listener, wherein the second area comprises an area closer to an occipital region than the first area, wherein the third area is a lower jaw of the listener, and wherein the air conduction device and the bone conduction device are on one of a right side or a left side of the head area of the listener.

4. The audio playback device according to claim 3, further comprising a bone conduction signal generator configured to harmonize the sound output from the bone conduction device to the sound output from the air conduction device.

5. The audio playback device according to claim 3, wherein the bone conduction device is further configured to output the sound of the first channel as if the sounds of the at least two channels is emitted from a position located farther from the second position of the head area of the listener.

6. The audio playback device according to claim 1, wherein the second position of the bone conduction device is an area above an auricle of the listener.

7. The audio playback device according to claim 1, wherein the third position of the sound source is localized in a head of the listener.

8. The audio playback device according to claim 6, wherein the third position of the sound source is localized at a central portion in a head of the listener.

9. The audio playback device according to claim 1, wherein the sound of the first channel output from the bone conduction device is sub-information and the sound of the second channel output from the air conduction device is main information, and wherein the sub-information different from the main information.

10. The audio playback device according to claim 9, wherein the sound output from the bone conduction device as the sub-information is localized at a position different from a center of the head area of the listener.

11. The audio playback device according to claim 9, wherein the main information is output as sounds from two air conduction devices.

12. The audio playback device according to claim 9, wherein the sound output from the bone conduction device as the sub-information is localized on one of a right side or a left side of the head area of the listener.

13. The audio playback device according to claim 12, wherein a localization position of the sound output from the bone conduction device as the sub-information is changed based on a prescribed rule.

14. The audio playback device according to claim 12, further comprising a signal processor configured to change a quality of the sound output from the bone conduction device as the sub-information.

15. The audio playback device according to claim 14, further comprising a conversion processor configured to surround process the sound output as the main information, subsequent to the change in the quality of the sound output from the bone conduction device as the sub-information.

* * * * *